United States Patent [19]

Drelich

[11] 4,084,033

[45] Apr. 11, 1978

[54] BONDED NONWOVEN FABRICS

[75] Inventor: Arthur H. Drelich, Plainfield, N.J.

[73] Assignee: Johnson & Johnson, New Brunswick, N.J.

[21] Appl. No.: 693,654

[22] Filed: Jun. 7, 1976

Related U.S. Application Data

[60] Continuation-in-part of Ser. No. 521,430, Nov. 6, 1974, abandoned, which is a continuation of Ser. No. 297,164, Oct. 12, 1972, abandoned, which is a division of Ser. No. 65,880, Aug. 21, 1970, which is a continuation-in-part of Ser. No. 800,265, Feb. 18, 1969, Pat. No. 3,649,330, which is a continuation-in-part of Ser. No. 618,317, Feb. 24, 1967, abandoned, and a continuation-in-part of Ser. No. 623,797, Mar. 10, 1967, Pat. No. 3,536,518, and Ser. No. 2,955, Jan. 14, 1970, abandoned, and a continuation-in-part of Ser. No. 817,177, Apr. 17, 1969, which is a continuation-in-part of Ser. No. 639,011, May 17, 1967, abandoned.

[51] Int. Cl.[2] ..... D04H 1/58; D04H 1/62; D04H 1/66

[52] U.S. Cl. ..... 428/198

[58] Field of Search ..... 428/195, 198

[56] References Cited

U.S. PATENT DOCUMENTS

| | | | |
|---|---|---|---|
| 3,536,518 | 10/1970 | Drelich | 428/198 |
| 3,649,330 | 3/1972 | Drelich | 428/198 |
| 3,720,562 | 3/1973 | Drelich | 428/198 |
| 3,765,974 | 10/1973 | Petersik et al. | 428/198 |

*Primary Examiner*—J.C. Cannon
*Attorney, Agent, or Firm*—Charles J. Metz

[57] ABSTRACT

Bonded fibrous nonwoven textile fabrics having excellent strength and textile-like softness, drape and hand which are intermittently bonded with synthetic resins in predetermined print patterns of binder areas having a relatively high, uniform concentration of from about 50% to about 120% by weight of resin binder in the binder areas, based on the weight of the fibers therein, said binder areas having very sharply defined borders or edges with a minimum of binder feathering thereat whereby the optical density of the bonded fibrous nonwoven textile fabric very sharply increases from substantially zero to a maximum of at least from about 0.6 to about 1.0 or greater in a distance of less than about 1 mm. (0.04 inch), and methods of depositing such synthetic resins from colloidal aqueous dispersions thereof onto wet fibrous webs to form the bonded fibrous nonwoven textile fabrics, comprising the use of (1) metal complex coordination compounds and (2) synthetic resins and/or surfactants, at least one of which contains a specific coordinating ligand capable of being affected by ions of said metals to control the total migration of the resin binder during such deposition.

13 Claims, 16 Drawing Figures

BONDED NONWOVEN FABRICS

This is a continuation-in-part of patent application Ser. No. 521,430, filed Nov. 6, 1974, now abandoned, which is a continuation of patent application Ser. No. 297,164, filed Oct. 12, 1972, now abandoned, which is a division of patent application Ser. No. 65,880 filed Aug. 21, 1970 which is a continuation-in-part of my earlier-filed, co-pending patent application Ser. No. 800,265, filed Feb. 18, 1969 now U.S. Pat. No. 3,649,330 which is a continuation-in-part of my earlier-filed patent application Ser. No. 618,317, filed Feb. 24, 1967, now abandoned. It is also a continuation-in-part of my earlier-filed, co-pending patent application Ser. No. 623,797, filed Mar. 10, 1967 now U.S. Pat. No. 3,536,518 and my earlier-filed, co-pending patent application Ser. No. 2,955, filed Jan. 14, 1970 now abandoned. And, it is also a continuation-in-part of my earlier-filed, co-pending patent application Ser. No. 817,177, filed Apr. 17, 1969 which is a continuation-in-part of my earlier-filed patent application Ser. No. 639,011, filed May 17, 1967, now abandoned.

The present invention relates to porous, absorbent, fibrous sheet materials and to their methods of manufacture. More particularly, the present invention is concerned with the so-called bonded, "nonwoven" textile fabrics, i.e., fabrics produced from textile fibers without the use of conventional spinning, weaving, knitting or felting operations. Although not limited thereto, the invention is of primary importance in connection with nonwoven fabrics derived from "oriented" or carded fibrous webs composed of textile-length fibers, the major proportion of which are oriented predominantly in one direction.

Typical of such fabrics are the so-called "MASSLINN" nonwoven fabrics, some of which are described in greater particularity in U.S. Pat. Nos. 2,705,687 and 2,705,688, issued Apr. 5, 1955, to D. R. Petterson et al. and I. S. Ness et al., respectively.

Another aspect of the present invention is its application to nonwoven fabrics wherein the textile-length fibers were originally predominantly oriented in one direction but have been reorganized and rearranged in predetermined designs and patterns of fabric openings and fiber bundles. Typical of such latter fabrics are the so-called "KEYBAK" bundled nonwoven fabrics, some of which are described in particularity in U.S. Pat. Nos. 2,862,251 and 3,033,721, issued Dec. 2, 1958 and May 8, 1962, respectively, to F. Kalwaites.

Still another aspect of the present invention is its application to nonwoven fabrics wherein the textile length fibers are disposed at random by air-laying techniques and are not predominantly oriented in any one direction. Typical nonwoven fabrics made by such procedures are termed "isotropic" nonwoven fabrics and are described, for example, in U.S. Pat. Nos. 2,676,363 and 2,676.364, issued Apr. 27, 1954, to C. H. Plummer et al.

And, still another aspect of the present invention is its application to nonwoven fabrics which comprise textile length fibers and which are made basically by conventional or modified aqueous papermaking techniques such as are described in greater particularity in pending patent application, Ser. No. 4,405, filed Jan. 20, 1970, now abandoned by P. R. Glor and A. H. Drelich. Such fabrics are also basically "isotropic" and generally have like properties in all directions.

The conventional base starting material for the majority of these nonwoven fabrics is usually a fibrous web comprising any of the common textile-length fibers, or mixtures thereof, the fibers varying in average length from approximately one-half inch to about two and one-half inches. Exemplary of such fibers are the natural fibers such as cotton and wool and the synthetic or man-made cellulosic fibers, notably rayon or regenerated cellulose.

Other textile length fibers of a synthetic or man-made origin may be used in various proportions to replace either partially or perhaps even entirely the previously-named fibers. Such other fibers include: polyamide fibers such as nylon 6, nylon 66, nylon 610, etc; polyester fibers such as "Dacron", "Fortrel" and "Kodel"; acrylic fibers such as "Acrilan", "Orlon" and "Creslan"; modacrylic fibers such as "Verel" and "Dynel"; polyoefinic fibers derived from polyethylene and polypropylene; cellulose ester fibers such as "Arnel" and "Acele"; polyvinyl alcohol fibers; etc.

These textile length fibers may be substituted either partially or entirely by fibers having an average length of less than about one-half inch and down to about one-quarter inch. These fibers, or mixtures thereof, are customarily processed through any suitable textile machinery (e.g., a conventional cotton card, a "Rando-Webber", a papermaking machine, or other fibrous web producing apparatus) to form a web or sheet of loosely associated fibers, weighing from about 100 grains to about 2000 grains per square yard or even higher.

If desired, even shorter fibers, such as wood pulp fibers or cotton linters, may be used in varying proportions, even up to 100%, where such shorter length fibers can be handled and processed by available apparatus. Such shorter fibers have lengths less than ¼ inch.

The resulting fibrous web or sheet, regardless of its method of production, is then subjected to at least one of several types of bonding operations to anchor the individual fibers together to form a self-sustaining web. One method is to impregnate the fibrous web over its entire surface area with various well-known bonding agents, such as natural or synthetic resins. Such over-all impregnation produces a nonwoven fabric of good longitudinal and cross strength, acceptable durability and washability and satisfactory abrasion resistance. However, the nonwoven fabric tends to be somewhat stiff and boardlike, possessing more of the properties and characteristics of paper or board than those of a woven or knitted textile fabric. Consequently, although such over-all impregnated nonwoven fabrics are satisfactory for many uses, they are still basically unsatisfactory as general purpose textile fabrics.

Another well-known bonding method is to print the fibrous web with intermittent or continuous straight or wavy lines, or areas of binder extending generally transversely or diagonally across the web and additionally, if desired, along the fibrous web. The resulting nonwoven fabric, as exemplified by a product disclosed in the Goldman U.S. Pat. No. 2,039,312 and sold under the trademark "MASSLINN", is far more satisfactory as a textile fabric than over-all impregnated webs in that the softness, drape and hand of the resulting nonwoven fabric more nearly approach those of a woven or knitted textile fabric.

The printing of the resin binder on these nonwoven webs is usually in the form of relatively narrow lines, or elongated rectangular, triangular or square areas, or annular, circular, or elliptical binder areas which are spaced apart a predetermined distance which, at its maximum, is preferably slightly less than the average fiber length of the fibers constituting the web. This is based on the theory that the individual fibers of the fibrous web should be bound together in as few places as possible.

The nominal surface coverage of such binder lines or areas will vary widely depending upon the precise properties and characteristics of softness, drape, hand and strength which are desired in the final bonded product. In practice, the nominal surface coverage can be designed so that it falls within the range of from about 10 percent to about 50 percent of the total surface of the final product. Within the more commercial aspects of the present invention, however, nominal surface coverages of from about 15 percent to about 40 percent are preferable.

Such bonding increases the strength of the nonwoven fabric and retains substantially complete freedom of movement for the individual fibers whereby the desirable softness, drape and hand are obtained. This spacing of the binder lines and areas has been accepted by the industry and it has been deemed necessarily so, if the stiff and board-like appearance, drape and hand of the over-all impregnated nonwoven fabrics are to be avoided.

The nonwoven fabrics bonded with such line and area binder patterns have had the desired softness, drape and hand and have not been undesirably stiff or board-like. However, such nonwoven fabrics have also possessed some disadvantages.

For example, the relatively narrow binder lines and relatively small binder areas of the applicator (usually an engraved print roll) which are laid down on the fibrous web possesses specified physical dimensions and inter-spatial relationships as they are initially laid down. Unfortunately, after the binder is laid down on the wet fibrous web and before it hardens or becomes fixed in position, it tends to spread, diffuse or migrate whereby its physical dimensions are increased and its inter-spatial relationships decreased. And, at the same time, the binder concentration in the binder area is lowered and rendered less uniform by the migration of the binder into adjacent fibrous areas. One of the results of such migration is to make the surface coverage of the binder areas increase whereby the effect of the intermittent bonding approaches the effect of the over-all bonding. As a result, some of the desired softness, drape and hand are lost and some of the undesired properties of harshness, stiffness and boardiness are increased.

Various methods have been proposed to prevent or to at least limit such spreading, diffusing or migration tendencies of such intermittent binder techniques.

For example, U.S. Pat. No. 3,009,822, issued Nov. 21, 1961 to A. H. Drelich et al. discloses the use of a non-migratory regenerated cellulose viscose binder which is applied in intermittent fashion to fibrous webs under conditions wherein migration is low and the concentration of the binder in the binder area is as high as 35% by weight, based on the weight of the fibers in these binder areas. Such viscose binder possesses inherently reduced spreading, diffusing and migrating tendencies, thereby increasing the desired softness, drape and hand of the resulting nonwoven fabric. This viscose binder has found acceptance in the industry but the use of other more versatile binders has always been sought.

Resins, or polymers as they are often referred to herein as interchangeable terms, are high molecular weight organic compounds and, as used herein, are of a synthetic or man-made origin. These synthetic or man-made polymers have a chemical structure which usually can be represented by a regularly repeating small unit, referred as a "mer", and are formed usually either by an addition or a condensation polymerization of one or more monomers. Examples of addition polymers are the polyvinyl chorides, the polyvinyl acetates, the polyacrylic resins, the polyolefins, the synthetic rubbers, etc. Examples of condensation polymers are the polyurethanes, the polyamides, the polyesters, etc.

Of all the various techniques employed in carrying out polymerization reactions, emulsion polymerization is one of the most commonly used. Emulsion polymerized resins, notably polyvinyl chlorides, polyvinyl acetates, and polyacrylic resins, are widely used throughout many industries. Such resins are generally produced by emulsifying the monomers, stabilizing the monomer emulsion by the use of various surfactant systems, and then polymerizing the monomers in the emulsified state to form a stabilized resin polymer. The resin polymer is usually dispersed in an aqueous medium as discrete particles of colloidal dimensions (1 to 2 microns diameter or smaller) and is generally termed throughout the industry as a "resin dispersion", or a "resin emulsion" or "latex".

Generally, however, the average particle size in the resin dispersion is in the range of about 0.1 micron (or micrometer) diameter, with individual particles ranging up to 1 to 2 microns in diameter and occasionally up to as high as about 3 or 5 microns in size. The particle sizes of such colloidal resin dispersions vary a great deal, not only from one resin dispersion to another but even within one resin dispersion itself.

The amount of resin binder solids in the resin colloidal aqueous dispersion varies from about 1/10% solids by weight up to about 60% by weight or even higher solids, generally dependent upon the nature of the monomers used, the nature of the resulting polymer resin, the surfactant system employed, and the conditions under which the polymerization was carried out.

These resin colloidal dispersions, or resin emulsions, or latexes, may be anionic, non-ionic, or even polyionic and stable dispersions are available at pH's of from about 2.5 to about 10.5.

The amount of resin which is applied to the porous or absorbent material varies within relatively wide limits, depending upon the resin itself, the nature and character of the porous or absorbent materials to which the resins are being applied, its intended use, etc. A general range of from about 4% by weight up to about 50% by weight, based on the weight of the porous or absorbent material, is satisfactory under substantially all uses. Within the more commercial limits, however, a range of from about 10% to about 30% by weight, based on the weight of the porous or absorbent material, is preferred.

Such resins have found use in the coating industries for the coating of woven fabrics, paper and other materials. The resins are also used as adhesives for laminating materials or for bonding fibrous webs. These resins have also found wide use as additives in the manufacture of paper, the printing industry, the decorative printing of textiles, and in other industries.

In most instances, the resin is colloidally dispersed in water and, when applied from the aqueous medium to a wet porous or absorbent sheet material which contains additional water, is carried by the water until the water is evaporated or otherwise driven off. If it is desired to place the resin only on the surface of the wet porous or absorbent sheet material and not to have the resin penetrate into the porous or absorbent sheet material, such is usually not possible inasmuch as diffusion takes place between the aqueous colloidal rasin and the water in the porous material. In this way the colloidal resin tends to spread into and throughout the porous material and does not remain merely on its surface.

Or, if it is desired to deposit the resin in specific intermittent print pattern, such as is used in bonding nonwoven fabrics, the aqueous colloid tends to diffuse and to wick along the individual fibers and to carry the resin beyond the confines of the nominal intermittent print pattern. As a result, although initially placed on the nonwoven fabric in a specific intermittent print pattern, the ultimate pattern goes far beyond that due to the spreading or migration which takes place due to the diffusion of the water and the resin, until the water is evaporated or otherwise driven off.

I have discovered new resin binder compositions containing polymers colloidally dispersed in aqeuous media and new methods of applying such resin binder compositions to porous or absorbent fibrous materials, whereby the resins are applied in a controlled, relatively non-migrating manner. If it is desired that the resin be placed only on the surface of the porous or absorbent material, my compositions and methods will allow this to be done. Furthermore, if it is desired that the resin be impregnated throughout the material, from one surface to the other surface, again, my composition and method will allow this to be done.

In patent application Ser. No. 618,317 and 800,265, filed Feb. 24, 1967 and Feb. 18, 1969, respectively, there are disclosed improved methods of using emulsion polymerized resins which are so prepared as to be stable under acid conditions, i.e., an environment with a pH below 7.

In accordance with the invention disclosed in these patent applications, the resin dispersion comprises from about 0.1% to about 60% by weight of emulsion polymerized resin solids and from about 0.01% to about 10% by weight of the resin solids of a water soluble metal salt. The metal ion of the salt has a valence of at least +3 and the metal salt is capable of forming an insoluble oxide, hydroxide, or hydrated oxide under alkaline conditions.

If such a resin composition is utilized in applying resins to fibrous materials, the deposition of the resin and its migration or spreading tendencies on such fibrous materials may be controlled by applying the acidstable resin dispersion to the fibrous material while substantially simultaneously raising the pH of the dispersion to a value greater than 7. For example, if it is desired to apply the resin merely to the surface of the fibrous material, the pH of the fibrous material is raised to greater than 7 and the acid-stable dispersion having a pH less than 7 is applied to the fibrous materials by spraying techniques or by other methods which apply the resin dispersion basically only on the surface of the fibrous materials. Microscopic inspection of the fibrous materials and the resin which has been sprayed thereon will reveal that the resin has not penetrated into the fibrous material to any appreciable degree. This, of course, is due to the fact that the resin dispersion is stable as long as its pH remains on the acid side, that is, below 7. However, upon contacting the fibrous material having a pH greater than 7, the pH of the resin dispersion is raised to greater than 7, its stability vanishes, and it figuratively "freezes" in position whereby any migration or penetration inwardly from the point of initial deposition by the resin dispersion is instantly stopped.

Further, if the application of the resin employs a conventional rotogravure process using a conventional engraved-roll wherein a pattern is impressed and printed on the material, the resin print pattern will penetrate through the material completely due to the normal pressure of the print roll and will then coagulate and be fixed in place with minimal migration or lateral spread. Microscopic inspection of the material and the resin thereon will reveal that the resin has penetrated directly and completely through to the other surface of the material but with controlled and minimal migration or lateral spread from the point of initial deposition.

On the other hand, if the fibrous material has or is given a pH of less than 7 and the resin dispersion which, of course, also has a pH of less than 7 is applied by a conventional engraved print roll in a rotogravure process, the acid stable dispersion will retain its stability after deposition and its tendency to migrate or spread laterally will continue to exist. Therefore, the fibrous material and the resin dispersion must be substantially immediately treated to raise the pH to greater than 7. The resin will then be deposited through the fibrous material from the top surface to the bottom in the print patterns of the engraved print roll but the substantially immediate conversion to a system having a pH greater than 7 will immediately control migration or lateral side spread from the point of initial deposition.

The principles of the invention described in these patent applications also find application in impregnation or "over-all" bonding processes, wherein a fibrous material is passed into and through an impregnating bath of the acid-stable resin dispersion. It has been noted that the resin dispersion which substantially completely impregnates the fibrous material has a tendency to migrate to the surfaces thereof, particularly during the drying process, leaving the center with a lesser concentration of resin solids, and creating a so-called "soft-center" which is often not desired. If the over-all bonded and impregnated material is treated with an alkali to raise the pH to above 7, before the drying step is initiated, then the impregnating resin dispersion is again "frozen" in place and there is substantially no tendency of the resin dispersion to migrate to the surfaces and create a "soft-center" during the drying operation. Other variations will, of course, be readily apparent to one skilled in the art.

In the dispersion of the emulsion polymerized, colloidal resin particles, there exists around each particle, an electrokinetic charge generally called the Zeta Potential. In most colloids this charge is negative and tends to cause the particles to repel each other and hence, stay in the dispersed form. It is believed that the addition of the salts, as described above, to the colloidal resin dispersion allows this Zeta Potential to be controlled by controlling the pH of the dispersion. When the pH of the dispersion is brought to above about 7 in the presence of the appropriate metal salt, the Zeta Potential of the colloidal resin particles is reduced to substantially zero and the individual particles no longer repel each other. The dispersion becomes unstable and the deposition of the resin on other substances may be controlled. This, of course, is only one suspected theory as to why my new composition allows for controlled resin deposition.

The salts used in accordance with this invention described in these patent applications are the salts of metals, wherein, the cation has a positive valence of 3 or higher. Suitable examples of such metals are zirconium, thorium, aluminum, iron, chromium, etc. The salt may be sulfate, acetate, nitrate, chloride, etc., or virtually any salt so long as the metal ion has a positive valence of 3 or greater. The salt must be capable of forming an insoluble oxide, hydroxide or hydrated oxide under alkaline conditions.

The amount of salt used will vary in accordance with the resin used and with the degree of control of the resin deposition that is desired. From about 0.01% to 10% or even higher by weight of the amount of resin solids present of metal salt may be used in accordance with the invention described in these patent applications. The control at the lower percentages of salt may be difficult in some instances and it is preferred to keep this lower limit above about 0.1%. It is uneconomical to use the higher amounts of salts especially in view of the relative cost of some of the salts compared to the resin and hence, it is preferred to keep the upper limit as 2% or less.

The resins which may be used in the method of the present invention are the emulsion polymerized resins which are in the form of solid resin particles dispersed in a liquid which is usually water. These resin dispersions or resin emulsions as they are called, are stabilized by various types of surfactant systems and the dispersion is stable under acid conditions. Suitable examples would be the polyvinyl chlorides, polyvinyl acetates, polyacrylic resins, etc. Materials such as natural rubber or synthetic rubber are unsuitable for use in accordance with the invention described in these patent applications as they have oleates or soaps present which appear to disrupt the mechanism of the present invention.

The resin emulsion may be anionic or non-ionic or in fact may be polyionic so long as it is stable under the acid conditions. By being stable under acid conditions it is meant that the resin dispersion will remain in the dispersed state at pH's of from 7 or slightly less than 7 down to the very acid pH's such as 2 or 3.

Generally, the particle size in the resin dispersions will vary from about 1/10 of a micron or smaller to 3 to 5 microns in size. And the amount of resin solids in the dispersion will vary from 1/10 of a percent solids up to 60% or even higher solids, generally dependent upon the resin used, the surfactant system used and the conditions under which the resin is polymerized.

The salt may be added to the resin dispersion either in its solid form or it may be initially disssolved in water and the salt solution added to the resin dispersion.

The resin dispersion is stable as long as the pH is less than 7, however, once the pH is raised to greater than 7, it appears that the Zeta Potential of the resin particles is reduced and possibly brought to zero which causes the resin particles to conglomerate or coagulate. If the surface of a fibrous web contains an alkali and the composition of resin and metal salt as previously described is placed on the web, the particles will immediately be attracted to the fibers and coagulate on the surface of the fibers.

The pH may be raised by any of the known alkalies such as ammonium hydroxide, sodium hydroxide, potassium hydroxide, lithium hydroxide, sodium carbonate or any other material which will give a pH of greater than 7. The alkali and amount of alkali used is controlled by economics and by the effect the alkali may have on the other material, for example, sodium hydroxide can do great damage to cotton fibers and will interfere with the curing of many resins. It will be readily apparent to one skilled in the art that suitable alkalies and concentrations may be chosen dependent on the material to be treated.

In some instances the resin may contain active cross-linking co-monomers, such as the acrylic resins having N-methylol acrylamide or other type groups. When such resins are used in the presence of certain metal salts, especially zirconium salts, the zirconium may cross-link and form various complexes with these resins which in turn improves the binding properties of the resin. It appears to be immaterial whether the metal salt cross-links or does not cross-link the resin as far as controlling the deposition of the resin in accordance with the present invention.

In patent applications Ser. Nos. 623,797 and 2,955, filed Mar. 10, 1967 and Jan. 14, 1970, respectively, there are disclosed other improved methods of using emulsion polymerized resins which are so prepared as to be stable under alkaline conditions, i.e., pH's of 7 to 9 or higher.

In accordance with the invention disclosed in these latter two patent applications, there is utilized a stable emulsion polymerized resin dispersion having a pH of from about 7 to 9 and an anionic surfactant selected from the class consisting of alkyl aromatic sulfonic acids, alkyl sulfonic acid and carboxylic acids. The dispersion comprises from about 0.1% to 75% by weight of emulsion polymerized resin solids, from about 0.1% to 5% by weight of the resin solids of an anionic surfactant selected from the class consisting of alkyl aromatic sulfonic acids, alkyl sulfonic acids and carboxylic acids and from about 0.01% to 2% by weight of the resin solids of a metal chelate compound.

If the resin composition described in these patent applications is applied to porous materials, its deposition may be controlled by applying it to the porous material while substantially simultaneously lowering its pH to a value less than 7. For example, if it is desired to apply the resin merely to the surface of the porous material, the pH of the porous material is lowered to less than 7 and the dispersion, in accordance with the present invention, then applied to the porous material. The resin will be deposited substantially only on the surface of the porous material. On the other hand, if the porous material is given a pH of greater than 7 and the resin applied and then the porous material substantially immediately treated to lower its pH to less than 7, the resin will be deposited throughout the porous material. Other variations will, of course, be readily apparent to one skilled in the art.

It is believed that the anionic surfactant in the resin dispersion system maintains the colloidal dispersion of solid particles in a stable dispersed form. When a potentially strong cation such as is present in a chelate compound is introduced in the resin dispersion and the resin dispersion made acid forming the cation, the cation destroys the surfactant system precipitating the resin particles and allowing for control of the deposition of the resin on other substances. This, of course, is only one suspected theory as to why my new composition allows for controlled resin deposition.

The metal chelate compounds suitable for use with the invention disclosed in these patent applications are compounds in which atoms of the same chelate molecule are coordinated with a metal ion. Suitable metals in the chelate compound are calcium, magnesium, iron, zinc, cooper, tin, etc. Suitable chelate compounds are the metal chelates of ethylenediaminetetraacetic acid, the metal chelates of salicylaldehyde imine, the metal chelates of condensed phosphates, the metal chelates of ammonium triacetic acid, etc.

The amount of metal chelate compound used will vary in accordance with the resin used and with the degree of control of the resin deposition that is desired. From about 0.01% to 2% or even higher by weight of the amount of resin solids present of the metal chelate compound may be used in accordance with the present invention. It is uneconomical to use the higher amounts of chelates especially in view of the relative cost of some of the chelates compared to the resin and hence, it is preferred to keep the upper limit at 2% or less.

The resins which may be used in the method disclosed in these patent applications are the emulsion polymerized resins which are in the form of solid resin particles dispersed in a liquid which is usually water. These resin dispersions or resin emulsions as they are called, are stabilized by an anionic surfactant system and the dispersion is stable at pH's of 7 to 9. Suitable examples are the polyvinyl chlorides, polyvinyl acetates, polyacrylic resins, synthetic rubber latexes, etc.

Generally, the particle sizes in the resin dispersions vary from about 1/10 of a micron or smaller to 3 to 5 microns in size. And the amount of resin solids in the dispersion varies from 1/10 of a percent solids up to 60% or even higher solids, generally dependent upon the resin used, the surfactant system and the conditions under which the polymerization was carried out.

The surfactant system used must be anionic and the anionic surfactant must be capable of precipitation by a cation. Suitable anionic surfactants are the alkyl aromatic sulfonic acids, alkyl sulfonic acids and the carboxylic acids, such as dodecyl benzene sulfonate, octyl benzene sulfonate, hexyl benzene sulfonate, octadecyl benzene sulfonate, cetyl sulfonate, hexyl sulfonate, dodecyl sulfonate, octadecyl sulfonate, and the sodium and potassium fatty acid soaps containing from 5 to 18 carbon atoms. Other anionic surfactants include sodium p-1-methyl alkyl benzene sulfonates in which the alkyl group contains from 10 to 16 carbon atoms, the sodium di-n-alkyl sulfosuccinates in which the alkyl groups contain from 4 to 12 carbon atoms, the potassium n-alkyl malonates in which the alkyl group contains from 8 to 18 carbon atoms, the potassium alkyl tricarboxylates in which the alkyl group contains from 6 to 14 carbon atoms, the alkyl betaines in which the alkyl group contains from 6 to 14 carbon atoms, the ether alcohol sulfates, sodium n-alkyl sulfates, containing from 6 to 18 carbon atoms, etc.

The amount of surfactant used may vary from about 0.1% to 5% by weight of the resin solids dependent on the type resin being polymerized and the conditions under which it is polymerized.

The resin dispersion containing the metal chelate compound is stable as long as the pH is from about 7 to 9. However, once the pH is lowered below about 7, it appears that the metal cation is released and attacks the anionic surfactant system in the resin dispersion causing the resin particles to agglomerate or coagulate. If the surface of a fibrous web contains a dilute acid and the composition of resin and metal chelate compound as previously described is placed on the web, the particles will immediately coagulate on the surface of the fibers.

The pH may be lowered by any of the known dilute acids such as acetic acid, or any other material which will give a pH of less than 7. The dilute acid and amount of acid used is controlled by economics and by the effect the acid may have on the other material. It will be readily apparent to one skilled in the art that suitable acids and concentrations may be chosen dependent on the material to be treated.

In patent applications Ser. Nos. 639,011 and 817,177, filed May 17, 1967 and Apr. 17, 1969, respectively, there are disclosed still other improved methods of using emulsion polymerized resins which are stable under moderately acid or alkaline conditions, i.e., pH's of from about 2.5 to about 10.5.

In accordance with the invention disclosed in these latter two patent applications, the deposition of emulsion polymerized resins on absorbent materials may be controlled by first treating the absorbent material with an aqueous solution containing from about 0.02% to 1% of a high molecular weight polyelectrolyte polymer having cationic constituents containing nitrogen in the form of amines, amine salts, imines, amides, etc., and applying the emulsion polymerized resin to the treated absorbent material. Unexpectedly, the diffusion of the resin in the absorbent material is greatly inhibited even in the presence of large amounts of water.

In the dispersion of the emulsion polymerized, colloidal resin particles, there exists around each particle, an electrokinetic charge called the Zeta Potential. In most colloids this charge is negative and tends to cause the particles to repel each other and stay in the dispersed form. It is believed that a polyelectrolyte polymer containing certain cationic constituents reduces the Zeta Potential of the resin particles and by so doing inhibits the particle from diffusing in its water carrier. This, of course, is one suspected theory as to why my new methods allow for the control of the deposition of resins on absorbent materials.

The desired binder migration control resulting from the pretreatment of the absorbent material with the aqueous polyelectrolyte solution and the subsequent printing of the impregnated absorbent material with the desired pattern of polymeric resin binder, however, is realized fully only if the printing with the polymeric resin binder takes place while the absorbent material is still wet with the polyelectrolyte solution. Under such circumstances, the penetration of the polymeric resin binder into the absorbent material rapidly takes place under controlled conditions and resin bonding takes place completely through the absorbent material from the top surface to the bottom surface substantially instantaneously.

Such a bonded absorbent material with a suitable binder is capable of withstanding laundering and/or dry cleaning; it withstands relatively rough usage and has good abrasion resistance.

However, if drying of the absorbent material were permitted subsequent to the impregnation with the polyelectrolyte solution and the polymeric resin binder were to be applied to the dried absorbent material, there would be very little penetration of the polymeric resin binder into the absorbent material and there would merely be a surface deposition of polymeric resin binder on the top surface of the absorbent material. As a result, the absorbent material, being unbonded on the back side, would not be acceptable as a uniformly or adequately bonded product, for example, in the nonwoven fabric industry. It would be incapable of withstanding laundering; it would fall apart in use; and the unbonded back surface would be incapable of resisting abrasion.

The polyelectrolyte compounds suitable for use are the high molecular weight polymers which are water soluble or colloidally dispersible and have a repeating cationic constituent on the polymer backbone. The cationic substituents suitable for use in accordance with the invention are those groups containing nitrogen having a positive charge as are well known in the art, it includes the amines, amine salts, imines, amides, etc.

The amount of polyelectrolyte compound used will vary in accordance with its cationic activity, the resin used and the degree of control of resin deposition that is desired. From about 0.1% to 5% of polyelectrolyte by weight of the resin to be deposited on the absorbent surface may be used in accordance with the invention disclosed in these patent applications. It is uneconomical to use the higher amounts of polyelectrolytes especially in view of the relative cost of some of these compounds compared to the resin and hence, it is preferred to keep the upper limit at 5% or less.

The resins which may be used in the method of the invention disclosed in these patent applications are the emulsion polymerized resins which are in the form of solid resin particles dispersed in a liquid which is usually water. These resin dispersions or resin emulsions as they are called, may be anionic, non-ionic or even polyionic and the dispersion is stable at pH's of 2.5 to 10.5. Suitable examples are the polyvinyl chlorides, polyvinyl acetates, polyacrylic resins, etc.

Generally, the particle size in the resin dispersions will vary from about 1/10 of a micron or smaller to 3 to 5 microns in size. The amount of resin solids in the dispersion will vary from 1/10 of a percent solids up to 75% or even higher solids, generally dependent upon the resin used, the surfactant system and the conditions under which the polymerization was carried out.

The amount of resin which is applied to the absobent material varies within relatively wide limits, depending upon the resin binder itself, the nature and character of the absorbent material being bonded, its intended use, etc. A range of from about 4% by weight to about 50% by weight, based on the weight of the absorbent material, is satisfactory under substantially all uses. Within the more commercial limits, however, a range of from about 5% by weight to about 30% by weight, based on the weight of the absorbent material, is preferred.

In carrying the invention disclosed in these patent applications into practice, the polyelectrolyte is dissolved or dispersed in an aqueous medium and the aqueous medium containing the polyelectrolyte applied to the absorbent material to be treated with resin. The medium containing the polyelectrolyte may be sprayed or padded onto the absorbent material as desired. The resin dispersion is applied to the treated absorbent material by printing the resin dispersion on the material or by padding, spraying, impregnating or other techniques for applying emulsion polymerized resins to absorbent materials.

I have now discovered still another improved method of controllably depositing colloidal resin compositions on porous or absorbent materials whereby spreading, diffusing, and migration of the resin are controlled and are markedly reduced and wherein the concentration of the resin in the resin binder area reaches exceptionally high values. When applied to fibrous webs in the manufacture of nonwoven fabrics, excellent strength is obtained in the resulting fabrics along with desirable textile-like softness, hand and drape.

The improved method involves the use of an aqueous resin dispersion which comprises from about 0.1% to about 60% by weight on a solids basis of a colloidal resin containing a coordinating ligand, said resin dispersion being stable at pH's of about 7 and greater but which is unstable at pH's of below 7 when in the presence of heavy metal ions such as zirconium, chromium, nickel, cobalt, cadmium, zinc, vanadium, titanium, copper and aluminum.

The coordinating ligand is normally an acidic or proton donor group, especially those containing terminal hydroxy groups. Examples of hydroxy-containing coordinating ligands are: hydroxy —OH; carboxy —COOH; sulfino —SO(OH); sulfo —$SO_2$(OH); sulfonoamino —$NHSO_2$(OH); aci-nitro=NO(OH); hydroxyamino —NHOH; hydroxyimino = NOH; etc. It is to be observed that hydroxy-containing radicals contain a hydrogen atom which is capable of dissociating to form an $H^+$ ion or proton.

The colloidal resins possessing a hydroxy-containing coordinating ligand are obtained by copolymerizing from about 92% by weight to about 99% by weight of a monomer or a mixture of monomers of the group comprising vinyl halide, vinyl ester, or vinyl ether monomers including, for example, vinyl chloride, vinyl acetate and vinyl ethyl ether; olefins such as ethylene and propylene; acrylic and methacrylic monomers including, for example, ethyl acrylate, ethyl hexyl acrylate, methyl acrylate, propyl acrylate, butyl acrylate, hydroxyethyl acrylate, dimethyl amino ethyl acrylate, methyl methacrylate, ethyl methacrylate, isopropyl methacrylate, butyl methacrylate, acrylonitrile, methacrylonitrile, acrylamide, N-isopropyl acrylamide, N-methylol acrylamide, methacrylamide; vinylidene monomers such as vinylidene chloride; diene monomers including, for example, 1,2-butadiene, 1,3-butadiene, 2-ethyl-1,3-butadiene; styrene monomers including, for example, styrene, 2-methyl styrene, 3-methyl styrene, 4-methyl styrene, 4-ethyl styrene, 4-butyl styrene; and other polymerizable monomers, with a relatively small amount, on the order of from about 1% by weight to about 8% by weight of an unsaturated acid containing a terminal hydroxy group such as the $\alpha,\beta$-unsaturated carboxylic acids including acrylic acid, methacrylic acid, fumaric acid, maleic acid, itaconic acid, crotonic acid, isocrotonic acid, angelic acid, tiglic acid, etc. Anhydrides which exist of these acids are also of use. Other $\alpha,\beta$-unsaturated acids are of use and include 2-sulfoethyl methacrylate, styrene sulfonic acid, vinyl phosphonic acid, etc.

It is to be appreciated that more than one monomer may be included in the polymerization with the $\alpha,\beta$-unsaturated acid containing a terminal hydroxy group. An outstanding example of the use of more than one monomer is the polymerization of butadiene and styrene with an $\alpha,\beta$-unsaturated acid such as acrylic acid, methacrylic acid, fumaric acid, maleic acid, or itaconic acid. Anhydrides, for example, maleic anhydride, are also of use.

To the resulting emulsion polymerized composition containing the colloidal resin with its coordinating ligand is added a small amount of from about 0.1% by weight to about 3% by weight, based on the weight of the synthetic resin solids, of a coordination metal complex compound wherein the central metallic atom is zirconium, chromium, nickel, cobalt, cadmium, zinc, vanadium, titanium, copper or aluminum.

Examples of such coordination compounds are:

ammonium carbonato zirconate $(NH_4)_3[Zr\ OH\ (CO_3)_3]\cdot H_2O$ sodium tetraoxalato zirconate $Na_4[Zr(C_2O_4)_4]\cdot 3H_2O$ ammonium heptafluoro zirconate $(NH_4)_3[ZrF_7]$ ammonium tetrathiocyanato diammine chromate $NH_4[Cr(NCS)_4(NH_3)_2]\cdot H_2O$ sodium pentacarbonyl chromate $Na_2[Cr(CO)_5]$ hexammine chromium chloride $[Cr(NH_3)_6]Cl_3\cdot H_2O$ hexa urea chromium fluosilicate $[Cr(CON_2H_4)_6]_2\cdot(SiF_6)_3\cdot 3H_2O$ chloro pentammine chromium chloride $[Cr(NH_3)_5\cdot Cl]Cl_2$ hexammine nickel chloride $[Ni(NH_3)_6]Cl_2$ sodium tetracyano nickelate $Na_2[Ni(CN)_4]\cdot 3H_2O$ hexammine nickel bromide $[Ni(NH_3)_6]Br_2$ hexammine nickel chlorate $[Ni(NH_3)_6](ClO_3)_2$ hexammine nickel iodide $[Ni(NH_3)_6]I_2$ hexammine nickel nitrate $[Ni(NH_3)_6](NO_3)_2$ tetra pyridine nickel fluosilicate $[Ni(C_5H_5N)_4]SiF_6$ tetrammine zinc carbonate $[Zn(NH_3)_4]CO_3$ tetrammine zinc sulfate $[Zn(NH_3)_4]SO_4$ potassium tetracyano zincate $K_2[Zn(CN)_4]$ sodium tetrahydroxo zincate $Na_2[Zn(OH)_4]$ diammine zinc chloride $[Zn(NH_3)_2]Cl_2$ tetrapyridine zinc fluosilicate $[Zn(C_5H_5N)_4]SiF_6$ sodium tetrahydroxo aluminate $Na_2[Al(OH)_4]$ potassium trioxalato aluminate $K_3[Al(C_2O_4)_3]$ tetrapyridine cadmium fluosilicate $[Cd(C_5H_5N)_4]SiF_6$ hexammine cobalt chloride $[Co(NH_3)_6]Cl_3$ hexammine cobalt iodide $[Co(NH_3)_6]I_2$ hexammine cobalt nitrate $[Co(NH_3)_6](NO_3)_3$ hexammine cobalt sulfate $[Co(NH_3)_6]SO_4$ hexammine cobalt bromide $[Co(NH_3)_6]Br_2$ dinitro tetrammine cobalt nitrate $[Co(NH_3)_4(NO_2)_2](NO_3)_3$ diammine copper acetate $[Cu(NH_3)_2](C_2H_3O_2)_2$ tetrammine copper sulfate $[Cu(NH_3)_4]So_4\cdot H_2O$ tetrapyridine copper fluosilicate $[Cu(C_5H_5N)_4]SiF_6$ As defined herein, a metal complex coordination compound is one of a number of types of metal complex compounds, usually made by addition of organic or inorganic atoms or groups to simple inorganic compounds containing the metal atom. Coordination compounds are therefore essentially compounds to which atoms or groups are added beyond the number possible of explanation on the basis of electrovalent linkages, or the usual covalent linkages, wherein each of the two atoms linked donate one electron to form the duplet. In the cases of the coordination compounds, the coordinated atoms or groups are linked to the atoms of the coordination compound, usually by coordinate valences, in which both the electrons in the bond are furnished by the linked atoms of the coordinated group.

The emulsion polymerized, ligand-containing resin and the coordination compound exist together in a stable emulsion form and normally do not agglomerate, coagulate or precipitate, as long as the pH remains at about 7 or above. Ammonia, alkali hydroxides and carbonates, or other alkaline compounds may be used in order to insure such neutral or alkaline pH range. In some cases, excess $NH_4OH$ must be present in the mixture for stability.

Subsequently, when the emulsion is acidified to an acid pH below 7, the resin immediately coagulates and agglomerates in place with substantially no further spreading, diffusion or migration.

It is believed that, when the pH is reduced to below 7, the metal cation is released from the coordination compound and immediately attacks or reacts with the ligand-containing resin causing the resin particles to agglomerate or coagulate.

It is also to be appreciated that, when the pH is reduced to below 7, the metal cation which is released from the coordination compound also is capable of attacking or reacting with any other chemical compounds which are present and which possess anionic groups, particularly those containing terminal hydroxy groups such as hydroxy, carboxy, sulfino, sulfo, and like acid groups.

For example, the metal cation which is released immediately attacks a surfactant system which is anionic and contains surfactants such as alkyl aromatic sulfonic acids, alkyl sulfonic acids, the carboxylic acids, and other anionic surfactants described hereinbefore and in greater particularity in patent applications Ser. Nos. 623,797 and 2,955. Such anionic surfactants are present in the colloidal dispersion in amounts of from about 0.01% to about 2% by weight, based on the weight of the synthetic resin solids.

The specific surfactant which is selected for use in the resin composition does not relate to the essence of the invention. It is merely necessary that it possess the necessary properties and characteristics to carry out its indicated function of stabilizing the resin composition prior to the time that coagulation and precipitation of the resin is required. Additionally, in the event that it is desired that the surfactant assist in or promote the coagulation and precipitation function, then it must possess the necessary anionic groups, as described hereinbefore, which are capable of reaction due to the presence of the metal cations released from the metal complex coordination compound.

The mechanism of instant controlled agglomeration, coagulation and precipitation of the colloidal resin binder may therefore be triggered by reaction of the metal cation which is released and reacts with either the colloidal resin, or the anionic surfactant, or both.

The pH may be lowered in different ways in order to activate the reaction mechanism. For example, the porous or absorbent fibrous material may be pre-treated by being pre-wet with a sufficient quantity of an acidic material such as acetic acid, whereby the alkaline colloidal resin composition immediately becomes acid upon contact therewith. Or, if desired, the alkaline colloidal resin composition may be first printed on the alkaline or neutral porous or absorbent fibrous material and then substantially immediately treated with the acidic material, such as acetic acid, to reduce the pH to below 7 whereupon the colloidal resin particles substantially immediately controllably agglomerate or coagulate in place with no further spreading, diffusion or migration.

The acid which is used to acidify the colloidal resin composition is preferably a weak acid such as acetic acid, citric acid, phosphoric acid, lactic acid, tartaric acid, oxalic acid, etc., or an acid salt such as alum.

The pH may be lowered in other ways in order to activate the reaction mechanism. For example, in a case wherein the pH is created or affected by the presence of a volatile material such as ammonia, for example, heating to expel the volatile material will bring about the desired change in pH to activate the reaction mechanism.

When printed on a fibrous web during the manufacture of nonwoven fabrics, the controlled total migration of the resin binder solids may be reduced to as little as about 50% beyond the originally deposited area. In some instances, the migration is relatively negligible. Normally, however, the total controlled migrational increase in area of the resin binder solids, even under the most adverse conditions does not materially exceed about 200%. Such values are to be compared to increases in binder migration of at least about 300% and up to about 800% when emulsion polymerized resins are applied to fibrous porous absorbent sheet materials, unaided by the principles referred to or disclosed herein.

The concentration of the binder resin solids in the binder area is correspondingly increased and is in the range of from about 50% by weight to about 120% by weight, and more normally about 60% to about 80% by weight, based on the weight of the fibers in the binder area.

The excellent migration control exercised over the resin binder is illustrated in the drawings in which.

Figure 1:
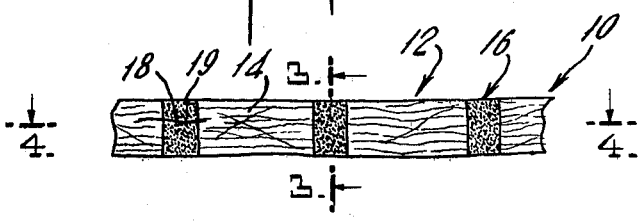
FIG. 1 is an enlarged, idealized cross-sectional view of a bonded nonwoven fabric illustrating the principles of the present invention.
Figure 2:
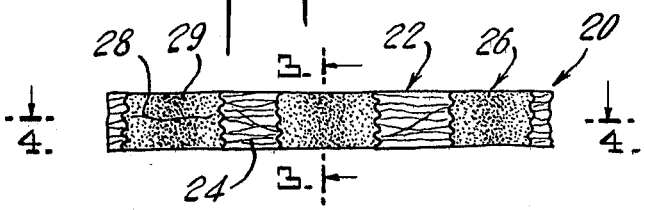
FIG. 2 is an enlarged, idealized cross-sectional view of a bonded nonwoven fabric, not utilizing the principles of the present invention.
Figure 3A:
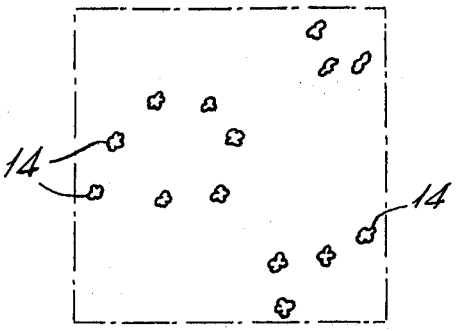
FIG. 3A is a further enlarged, idealized cross-sectional view of the nonwoven fabrics of FIGS. 1 and 2, taken on the line 3—3 thereof, before any resin binder has been applied to the fibrous web.
Figure 3B:
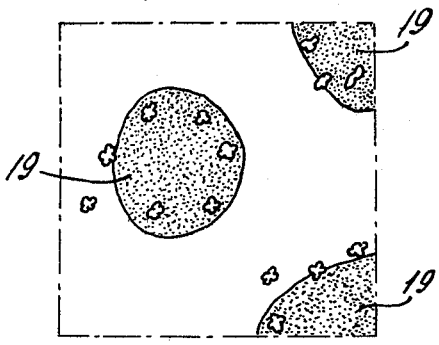
Figure 3C:
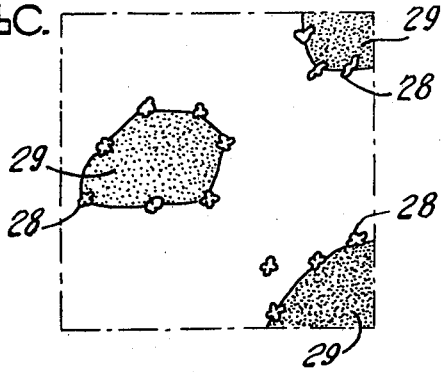
Figure 4A:
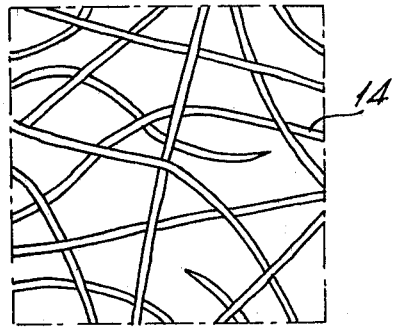
Figure 4B:
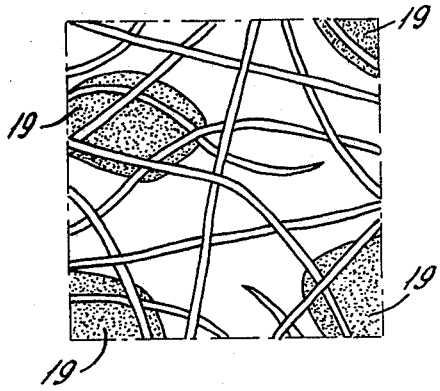
Figure 4C:
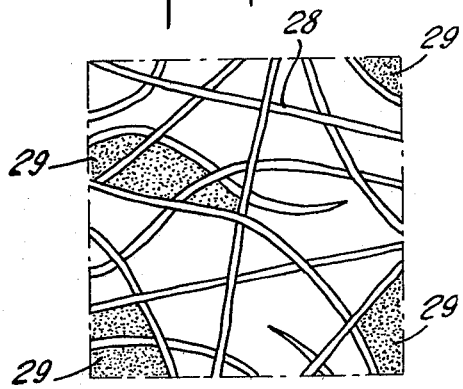
Figure 5:
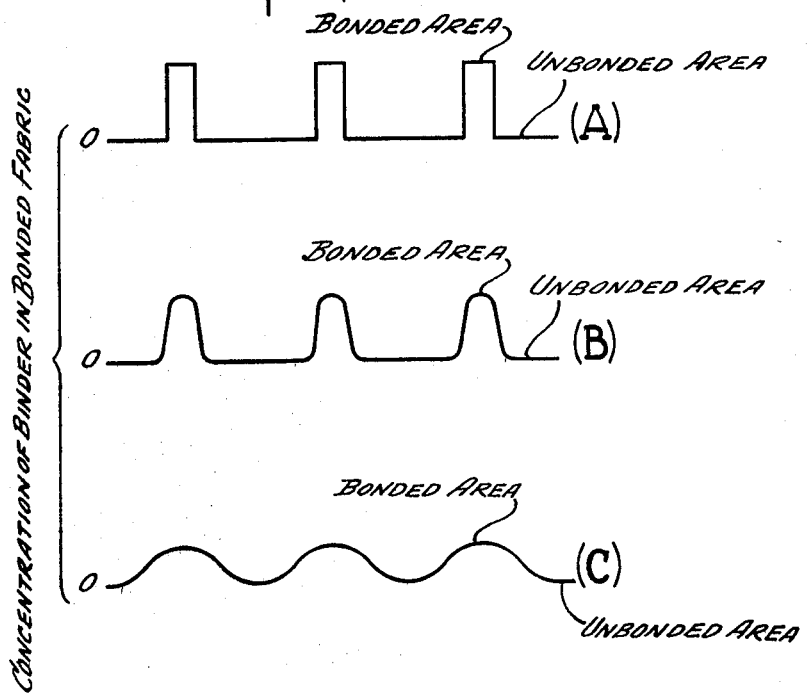
Figure 6:
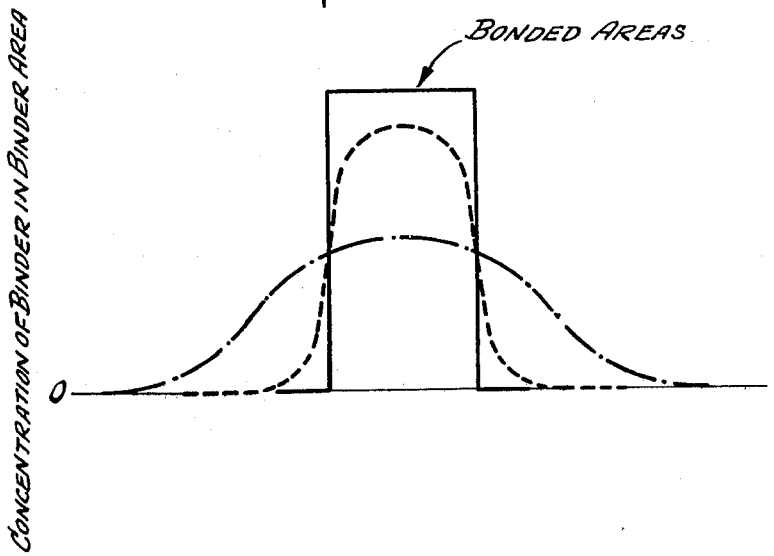
Figure 7:
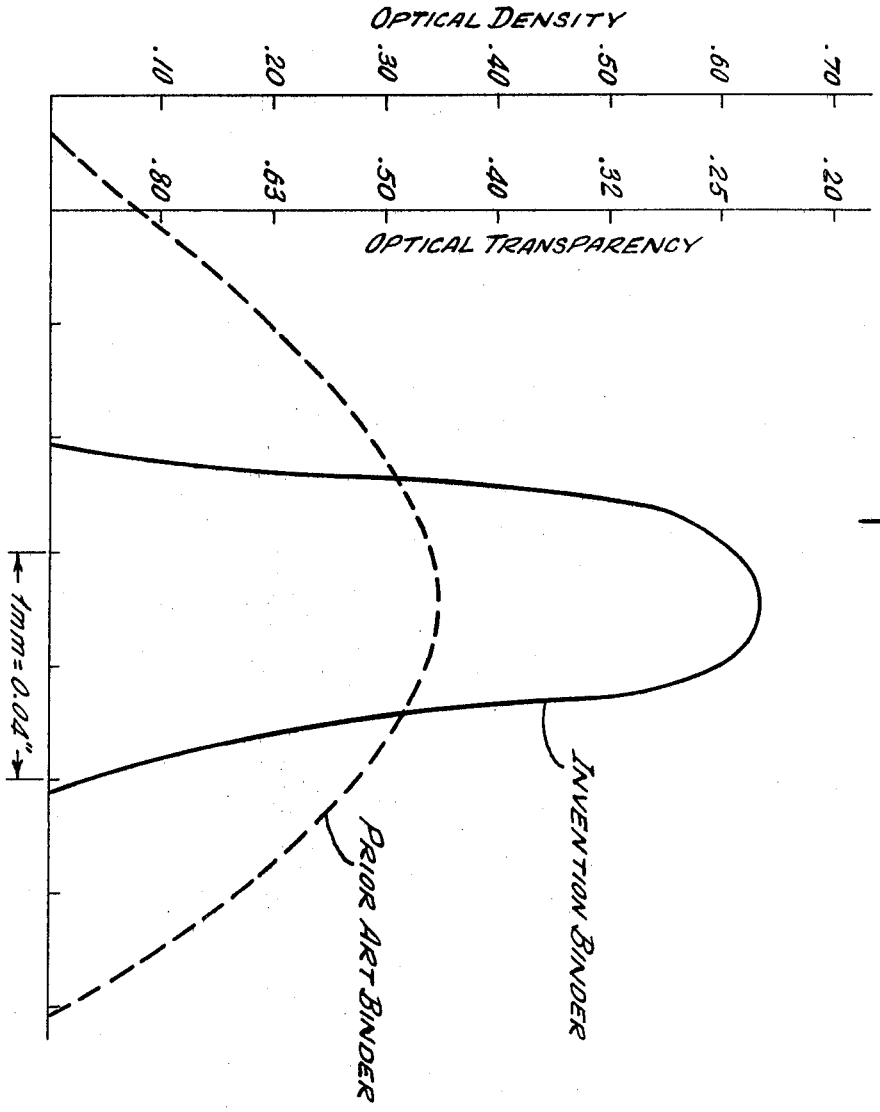

FIG. 3B is a further enlarged, idealized cross-sectional view of the nonwoven fabrics of FIGS. 1 and 2, taken on the line 3—3 thereof, at the moment the resin binder is applied to the fibrous web; it is also an enlarged, idealized cross-sectional view of the invention nonwoven fabric of FIG. 1, taken on the line 3—3 thereof, after the resin binder has set;

FIG. 3C is a further enlarged idealized, cross-sectional view of the fibrous web of FIG. 2 taken on the line 3—3 thereof, after the resin binder has set;

FIG. 4A is a further enlarged, idealized cross-sectional view of the nonwoven fabrics of FIGS. 1 and 2, taken on the line 4—4 thereof, before any resin binder has been applied to the fibrous web;

FIG. 4B is a further enlarged, idealized cross-sectional view of the nonwoven fabrics of FIGS. 1 and 2, taken on the line 4—4 thereof, at the moment the resin binder is applied to the fibrous web; it is also an enlarged idealized cross-sectional view of the invention nonwoven fabric of FIG. 1, taken on the line 4—4 thereof, after the resin binder has set;

FIG. 4C is a further enlarged, idealized cross-sectional view of the nonwoven fabric of FIG. 2, taken on the line 4—4 thereof, after the resin binder has set;

FIG. 5A is an idealized graph or histogram showing the surface coverage and the concentration of an ideal binder on a nonwoven fabric;

FIG. 5B is a graph or histogram showing the surface coverage and the concentration of a binder placed on a nonwoven fabric in accordance with the principles of the present invention;

FIG. 5C is a graph or histogram showing the surface coverage and the concentration of a binder placed on a nonwoven fabric but not in accordance with the principles of the present invention;

FIG. 6 shows a graph or histogram of the critical bonded areas of FIGS. 5A, 5B, and 5C in superimposed fashion to accentuate their differences and similarities;

FIG. 7 is a pair of superimposed graphs or histograms of the binder concentrations on nonwoven fabrics showing their differences.

Figure 8:
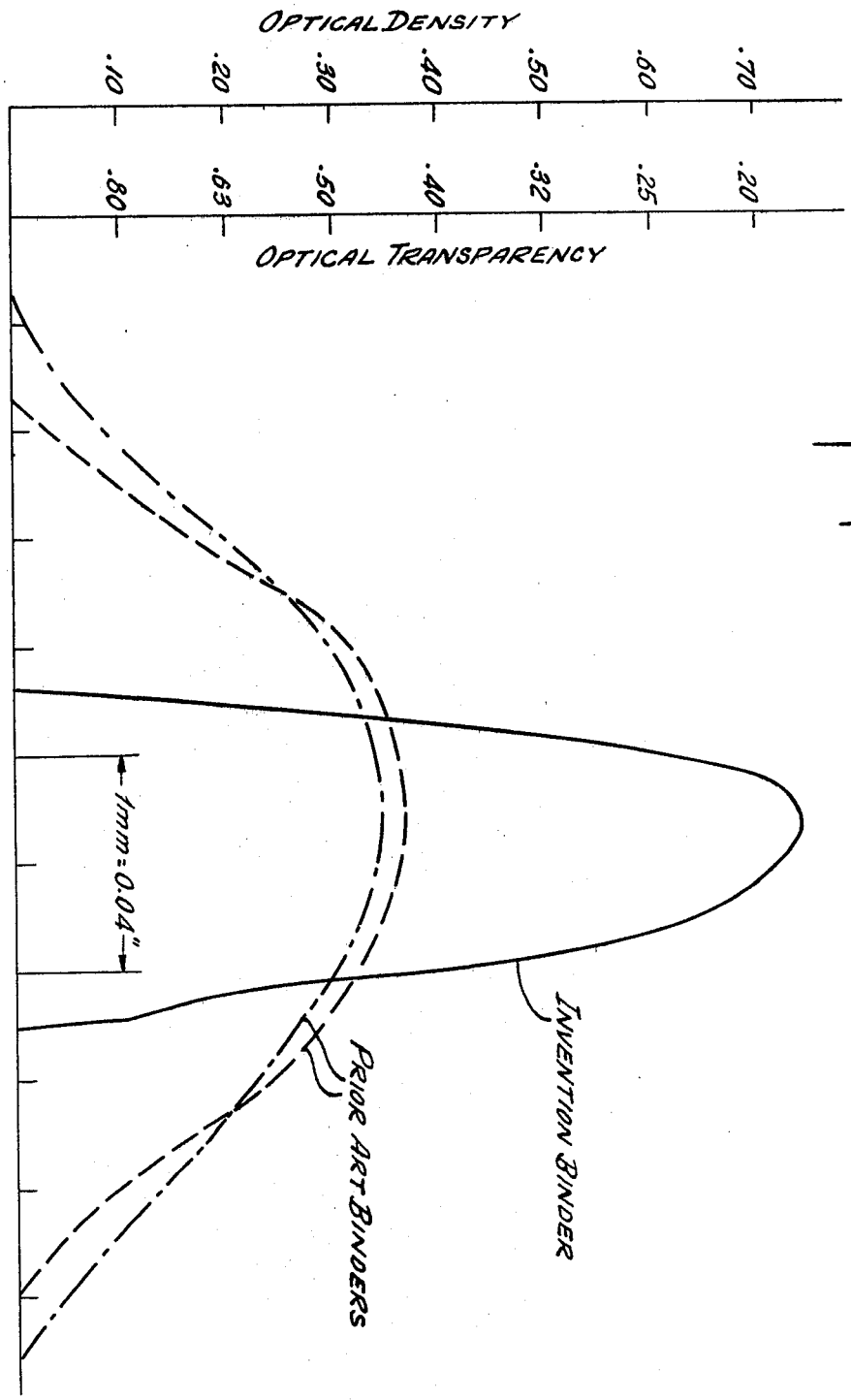
Figure 8:
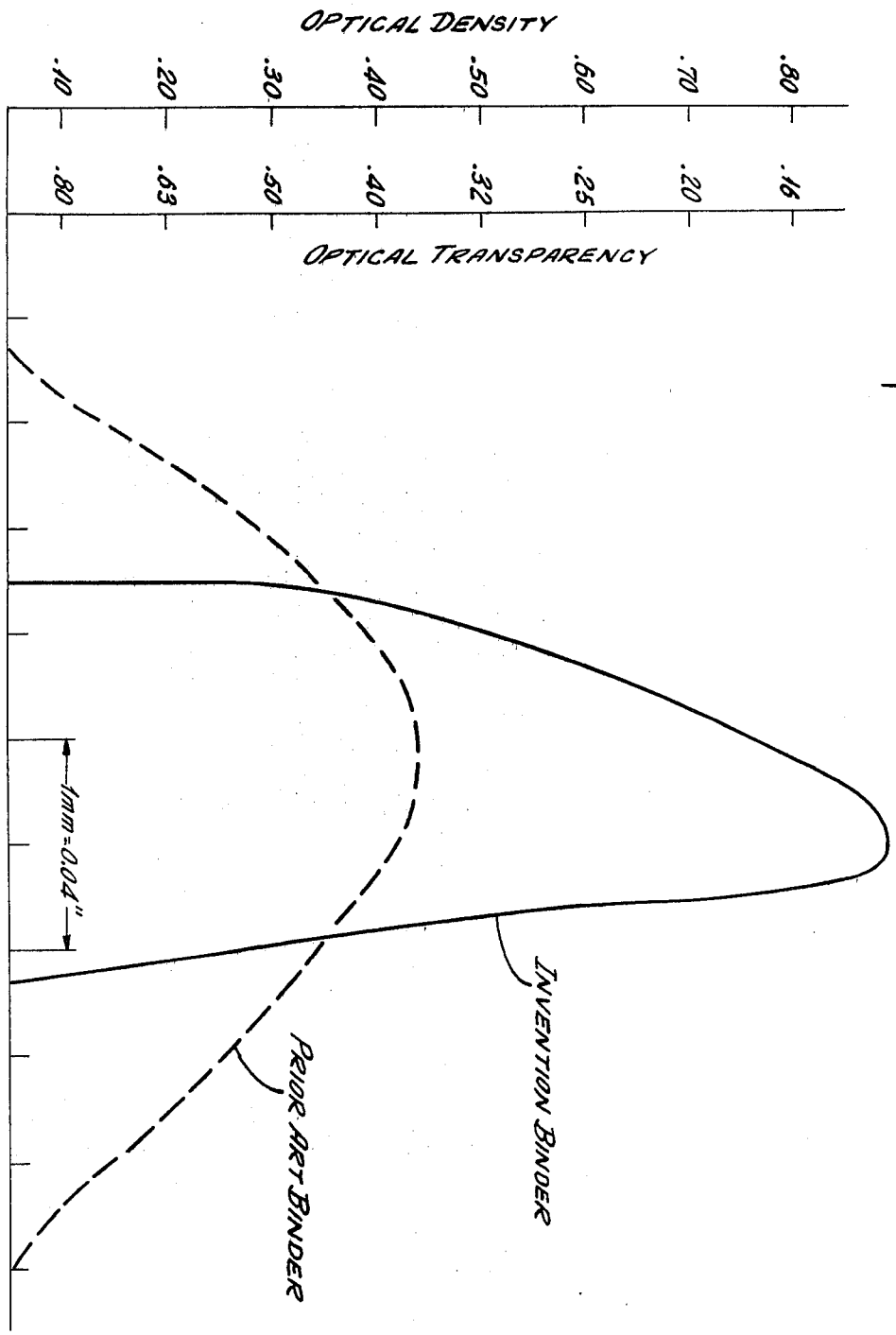
Figure 10:
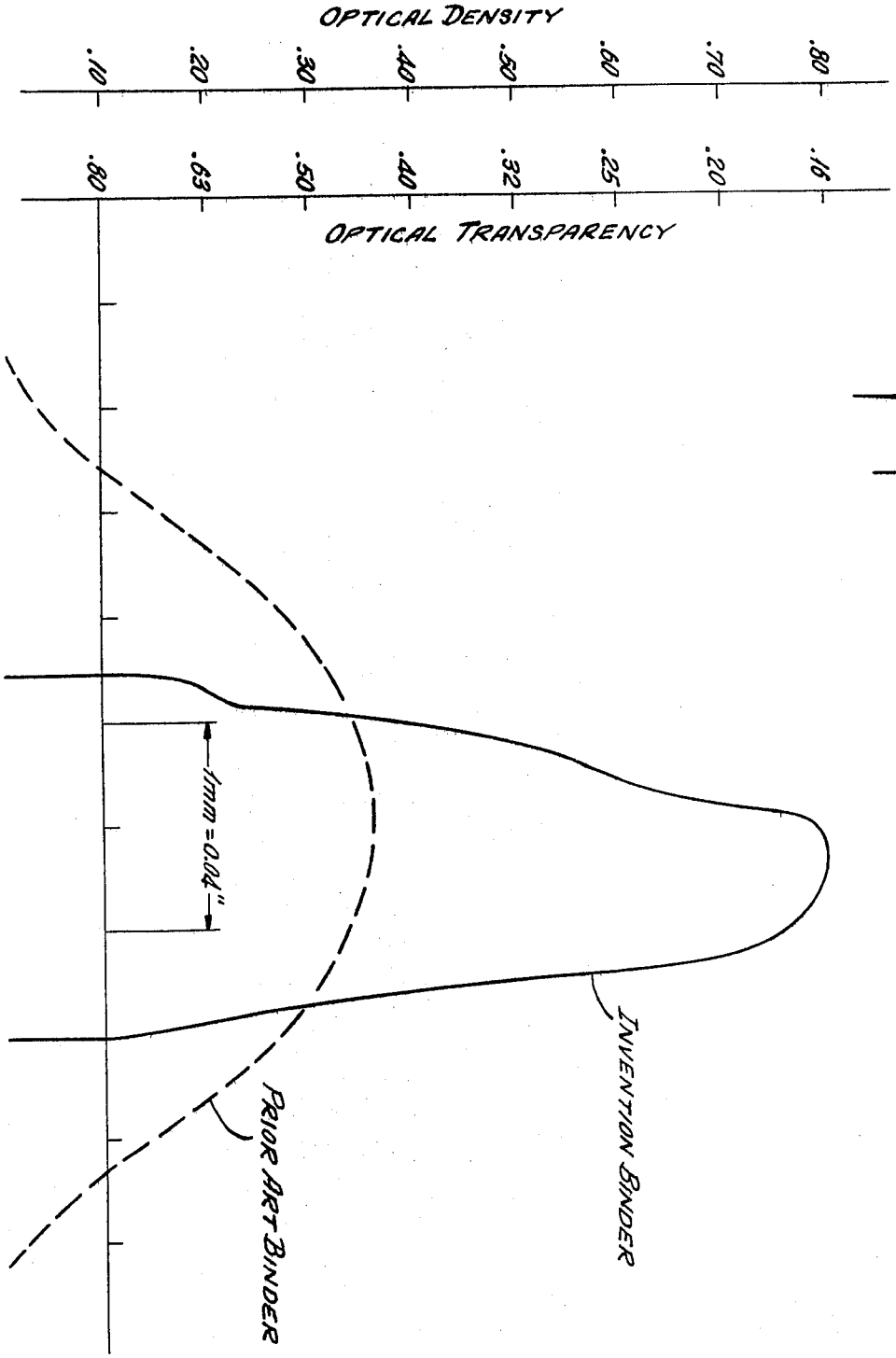

FIG. 8 is another graph or histogram of a binder deposition of a nonwoven fabric showing surface coverage and concentration of binder in the binder area;

FIG. 9 is another graph or histogram of a binder deposition on a nonwoven fabric showing the surface coverage and concentration of binder in the binder area; and FIG. 10 is still another graph or histogram of a binder deposition on a nonwoven fabric showing the surface coverage and concentration of binder in the binder area.

With reference to the drawings and with particular reference to FIG. 1 thereof, there is shown a bonded nonwoven fabric 10 which has been bonded according to the principles of the present invention. The bonded nonwoven fabric 10 comprises fibrous areas 12 of unbonded overlapping, intersecting fibers 14 and bonded areas 16 containing bonded fibers 18 and a resin binder 19. As shown, the bonded areas 16 extend completely through the bonded nonwoven fabric 10 from one surface to the other surface and possesses relatively straight, sharp, distinct edges or boundary lines, *16a* and *16b*.

The sharpness and distinctness of the edges or boundary lines which exist between the bonded areas 16 and the unbonded areas 12 is attested to by the fact that the optical density of the bonded nonwoven fabric 10 increases from about 0.0 optical density to as much as from about 0.6 to about 1.0 optical density in merely moving a distance of about 1 mm. (0.04 inch) or less, lengthwise of the nonwoven fabric from the unbonded area into the bonded area. The uniformity of the binder concentration in the bonded areas 16 of nonwoven fabric 10 is attested to by the fact that, after the optical density increases from about 0.0 to about 0.6 or more in moving a distance of about 1 mm from an unbonded area into a bonded area, the optical density remains at about 0.6 or higher in moving through the bonded area toward the next unbonded area of the fabric. The optical density thereafter decreases from its value of about 0.6 or higher to a value of about 0.0 in merely moving a distance of about 1 mm from the uniformly bonded area toward the next unbonded area. Thus it will be recognized that sides *16a, 16b* of the bonded areas, which sides correspond to the boundaries between the bonded and unbonded areas of the fabric, are relatively straight, sharp, and distinct. This feature will be described in greater detail hereinafter.

As defined herein, optical density varies generally proportionately to the concentration of binder and is equal to the logarithm (base 10) of the ratio of (1) the intensity of an incident ray ($I_i$) falling upon a transparent or a translucent medium to (2) the intensity of a transmitted ray ($I_t$) which passes through the transparent or translucent medium. This quantity ($\log_{10} I_i/I_t$) is therefore a measure of the degree of ability of light to pass through the medium. When the fibers are made transparent and the binder is made opaque, the optical density is a measure of the intensity or the concentration of the binder on the nonwoven fabric. Since it is frequently not possible to make the fibers transparent, an alternate procedure, based on differential staining of fiber and binder, measuring light reflectance may also be used.

Inasmuch as the optical density is a logarithmic function and difficult to compare directly, optical transparency will also be used in this description of the invention. As defined herein, optical transparency is equal to $I_t/I_i$, or it is the direct ratio of the intensity of the transmitted light ($I_t$) to the intensity of the incident light ($I_i$). Such a term is more easily employed for direct comparison purposes.

It is important to describe the procedures which are used for determining (1) the sharpness and the distinctness of the boundary lines which exist between the bonded areas and the unbonded areas; (2) the border or edge feathering and total surface coverage of the binder; (3) the optical densities and transparencies of various points in the bonded areas; (4) the concentration of the binder in the bonded areas; (5) the uniformity of the binder concentration in the bonded areas; etc.

It has long been known that the actual width of a bond on a nonwoven fabric is greater than the nominal width of the engraved line on the print roll which applied the binder to the fibrous web during the making of a bonded nonwoven fabric. The difference between the two widths is, of course, the binder migration.

It is relatively easy to measure the nominal width of the engraved line on the print roll. However, a problem has always existed as to the best method for accurately measuring the actual bond width on the bonded nonwoven fabric. Incorporating a dye or pigment in a resin binder and measuring the resultant colored binder area is misleading. It is now known that the binder spreads much farther in the fibrous web than the pigment or dye because of a chromatographic phenomenon among the fibers. As a result, a subjective viewing of a resin bonded nonwoven fabric will merely reveal the width of the pigmented or dyed area which is considerably less than that of the bonded area covered by the binder.

Incorporating a pigment or dye in a viscose binder, as compared to a resin binder, and measuring the resulting colored binder area may also be misleading, although it is believed that in the case of bonding with viscose, as differentiated from bonding with a resin binder, the binder stays more closely with the pigment or dye. In any event, however, the pigmented or dyed areas are probably less than the bonded fabric areas which are covered with a viscose binder.

In the case of practically all the resins used for binder purposes, differential staining techniques may be employed so that the rayon fibers are unstained and remain practically white while the resin binder becomes stained and taken on an intense color. Under magnification, the colored resin binder is discernible and distinguishable from the rayon fibers. Such differentially stained nonwoven fabrics have then been studied under relatively low power microscopes and the width of the actual binder line has been subjectively estimated by comparison to a standard scale, usually in the microscope eyepiece. The binder edge, especially in the case of a migrated print line, gradually fades to zero or substantially zero, and the visual estimation of the binder width is therefore a difficult, subjective procedure. It is now known that prior efforts to estimate binders widths have led to low estimates inasmuch as the extremes of the binder-feathering have been neglected.

The improvements brought about by the present invention are determined by measuring actual bond widths and relative binder content across a bond stripe by an objective method using an analytical instrument for the actual measurements. These improved methods will be described in greater detail hereinafter.

It has been observed that it is characteristic of migrated print bonded patterns to show a binder-feathering near the bond edges. On the other hand, when migration is controlled, binder-feathering is nonexistent and the line of demarcation between bonded area and non-bonded area is sharp. The feathering, however, in a migrated binder reflects the diffusion of binder into the water of the wet web and also the capillary absorption of liquid binder by the web structure. In contrast, when binder has been coagulated to control migration, diffusion, capillarity and feathering near the edge of the bond are essentially nonexistent.

An unusual feature of the feathering phenomenon is the fact that it is more pronounced on one side of the bonded area. It is believed that this is caused by the fact that the binder, as it is applied by an engraved print roll, tends to smear and migrate more on the trailing side of the applied binder. The leading edge, that is, the edge first contacted by the print roll, is usually cleaner with less smearing and less migration.

When binder migration is controlled, the total amount of binder applied may be selected to be the same but the binder is restricted to a smaller area within the web. Hence, binder concentration within the bond area is higher and the line of demarcation between bond and free-fiber areas is much sharper in controlled nonwoven fabrics. In fact, it is believed that the feathered edge of the bond area deleteriously affects nonwoven properties for the following reasons:

1. The low binder content in the feathered areas is sufficient to cause stiffness, but not sufficient to impart good strength.
2. The highest concentration of binder attainable in the bond area in non-controlled print areas is not sufficient to make bonds as strong as the fibers. On the other hand, when binder migration is controlled, the binder content is high enough to equal fiber strengths, but not so high that the bond feels nubby. Furthermore, the high concentration of binder in the bonded areas in a controlled printed fabric approaches (but does not reach) a continuous binder film. Therefore, a better carry-through of binder properties in the web is obtained, especially strength and resilience.

Several new concepts, and unexpected results are believed to be embodied in the controlled migration fabrics which have been made. A laboratory method for giving numerical values to the fiber-bond transition area has been developed, based on the staining properties of binder, and the optical characteristics of a stained bond area. By this method, the nonwoven fabric is stained with the proper dye or chemical reagent and the reflected light from the surface of the various areas of the fabric is measured. The intensity of staining across a bond is measured by means of its magnified image on the ground glass of a camera. The microscope image of the surface of the stained fabric on the camera ground glass is scanned with a light sensing instrument and a graph of the intensity of reflected light (as "Optical Density") versus location across a bond is made.

In order for this procedure to be quantitative and reproducible, it is necessary to specify many of the details, as follows. The print-bonded nonwoven fabric is differentially stained in a 1% solution of Celliton Fast Violet 6BA (manufactured by General Aniline and Film), by immersion for one minute in boiling solution and rinsing in cool water until the cellulosic fibers become white. This dye will stain all of the common types of binders including acrylics, vinyl acetates, butadienestyrene rubbers, vinyl chloride polymers, etc. Other dyes may be used as long as the base fibers are essentially undyed, and the resin itself is dyed an intense color. The fabrics are air-dried and mounted on a flat white surface. The mounted sample is placed on a graduated mechanical stage under a ground glass camera using lenses and distances to enlarge the image 20.0X by methods well known in the photographic and microscopic arts. This specimen is illuminated by two small spot lights mounted at about 45° above the specimen and at 180° from each other, that is, opposite each other in a straight line.

The probe of an optical densitometer is fixed at the focusing plane (the ground glass) of the camera. It is convenient to use a reflex housing so that the specimen can be examined visually or the reflected image can be measured simply by turning a mirror to deflect the light for observation or for measurement, respectively. The size of the probe is set at a 4×4 millimeter square.

The two lights illuminating the specimen are carefully placed to minimize the formation of shadows. An area of the test specimen which is completely free of binder is moved underneath the sensing area, and by means of the controls on the densitometer, the needle reading is set at "0" Optical Density.

The stage micrometer is manipulated to move the specimen in definite intervals of 0.1 mm., only along the axis perpendicular to the bond line. As the magnified image is traversed stepwise across the probe, light reflectivity readings are taken. Light reflectivity is measured as "Optical Density". As mentioned above, the actual size of the light sensing probe is 4×4 millimeters and is fixed to the screen where a 20.0X magnified image is projected. At an actual movement of 0.1 millimeter, the apparent movement is magnified to 2.0 millimeters at 20X magnification, hence, the probe of 4×4 mm. dimension reads an overlapping area with each consecutive reading. The purpose of choosing this probe size and obtaining overlap is to tend towards smoothing the curve. Otherwise, an erratic reading is obtained.

In other words, the differentially stained test sample, under constant illumination, is traversed across the field while a fixed light-sensing probe measures the light reflectance of its magnified image, hence, the comparative binder content across a single bond unit.

The intensity of the reflected light, in units of "Optical Density" yields a comparative measure of binder content across a binder pattern unit.

This procedure can be used on any nonwoven fabric so long as the rayon fibers or other fibers are white and are not colored significantly by the dye which stains the binder.

Such procedures establish that:

1. The binder content within the binder area is higher in controlled migration samples, and is in the range of about 50%–120% binder content (based on fiber weight in the same area).
2. The binder penetrates essentially throughout the entire thickness of the web. This is in sharp contrast to the products of dry printing where the binder stays on one side of the web.
3. The binder content across the binder area is more uniform in the controlled sample, that is, there is a virtual absence of feathering and practically no transition area between clean fiber and bond area.

Inasmuch as it can be arranged that the total amount of binder material in each bond unit of a controlled and an uncontrolled migrational sample of a nonwoven fabric is the same, as determined by chemical analysis, the areas under the curves in the histograms of these samples will denote the same amount of binder. However, as an artifact of the test procedures, based on the saturation color of the binder stain, the raw data taken by the hereindescribed procedures usually shows an apparently appreciable higher area under the curve for the migrated samples.

Hence, it is therefore necessary that the raw data be normalized by multiplying it by a factor less than one to bring the area under its curve to that of the controlled migration binder area. In this way, the controlled and uncontrolled migration bond areas can be examined and compared. This normalization has been done for FIGS. 7 through 10, but further refinement thereof may be necessary in some cases.

It is to be appreciated that regardless of whether raw data or normalized data is used, the zero points and the distances required to go from zero binder content to maximum binder content or to go from zero to maximum Optical Density are unchanged. On the other hand, however, the slopes of the curves and the apparent peak optical densities are changed.

In FIG. 2, there is illustrated another bonded nonwoven fabric 20 which has not been bonded according to the principles of the present invention. The bonded nonwoven fabric 20 comprises fibrous areas 22 of unbonded overlapping, intersecting fibers 24 and bonded areas 26 containing bonded fibers 28 and a resin binder 29. It is to be observed that the bonded areas 26, although they were as small as the bonded areas 16 of FIG. 1, when originally applied to the fibrous web, are very much larger in the finished fabric and have much greater actual surface coverage. Also, it is to be noted that the boundary lines of the binder areas are not relatively straight, nor are they sharp and distinct, and that the resin binder is concentrated in the center and feathers and gradually thins out as the binder edges are approached.

The lack of sharpness or distinctness of the boundary lines which exist between the bonded areas 26 and the unbonded areas 22 is attested to by the fact that the optical density of the bonded nonwoven fabric 20 increases from about 0.0 to only about 0.35 and that such is accomplished in moving a much greater distance of two or three millimeters lengthwise of the nonwoven fabric from the unbonded area into the bonded area.

In other words, the present invention provides for greater increases of intensity or concentrations of binder in shorter lengthwise distances of the bonded nonwoven fabric. As a result, the concentration of the binder in the binder areas is much greater which is, of course, very desirable. Also, the surface coverage of the bonded nonwoven fabrics by the binders of the present invention is very much decreased whereby strength and softness characteristics and properties are greatly improved.

FIG. 3A is an enlarged, idealized cross-sectional view of the fibers of the fibrous webs 10 and 20 before any resin binder has been applied thereto. These fibers are, of course, as yet unbonded. FIG. 3B is an enlarged, idealized cross-sectional view of the fibers of the fibrous webs 10 and 20 at the precise moment that the resin binder is applied thereto and before it has an opportunity to spread, migrate or diffuse. The resin dispersion is illustrated as droplets added to the water already present in the pre-wet fibrous web.

Application of the principles of the present invention causes the colloidally dispersed resin to agglomerate, coagulate and precipitate instantly whereby they exist in the final bonded nonwoven fabric substantially as shown in FIG. 3B.

In FIG. 3C, however, there is illustrated the effect of the migration, diffusion and spreading of the resin binder which takes place in the absence of instantaneous agglomeration, coagulation and precipitation after the binder is deposited on the fibrous web and before it has time to harden or set. It is to be observed that the resin binder has shifted to a position within a group of fibers and does not completely surround many fibers. The changes that have taken place in the transition from FIG. 3B to FIG. 3C are worthy of note.

FIG. 4A is an enlarged, idealized cross-sectional view of the fibers of the fibrous web 10 and 12 before any resin binder has been applied thereto. These fibers are, of course, as yet unbonded. FIG. 4B is an enlarged, idealized cross-sectional view of the fibrous webs 10 and 20 at the precise moment that the resin binder is applied thereto and before it has an opportunity to spread, diffuse or migrate. The resin is illustrated as droplets added to the water already present in the pre-wet fibrous web.

Application of the principles of the present invention causes the colloidally dispersed resin to agglomerate, coagulate and precipitate instantly whereby they exist in the final bonded nonwoven fabric substantially as shown in FIG. 4B.

In FIG. 4C, however, there is illustrated the effect of the migration, diffusion and spreading of the resin binder which takes place in the absence of instantaneous agglomeration, coagulation and precipitation after the binder is deposited on the fibrous web and before it has time to harden or set. It is to be observed that the resin binder has shifted to a position within a group of fibers and does not completely surround many fibers. The changes that have taken place in the transition from FIG. 4B to FIG. 4C are worthy of note.

One very important feature of the present invention, as mentioned previously, is the sharpness and definiteness of the edges or boundaries of the binder areas. In FIG. 5A, there is illustrated a graph or histogram depicting the change in the concentration of the binder in the bonded fabric as measurements are taken, progressively lengthwise thereof, passing through bonded areas and non-bonded areas. The ideal situation (FIG. 5A)

shows no binder whatsoever in the unbonded area and a steep 90° rise at the beginning of the binder area to a maximum flat plateau of high optical density and high uniform binder concentration in the bonded area, followed by a steep 90° drop to zero binder concentration and zero "Optical Density" at the end of the bonded area. Such 90° slopes are, of course, ideal.

The variation in the concentration of the binder content with respect to the bonded fabric in the case of the present invention is shown in FIG. 5B. The slopes of the leading and trailing edges or boundaries of the binder areas are very close to 90° and are in the range of from about 75° to about 90°. As a result of such steep slopes, the maximum flat plateau is practically at the same level or very slightly lower than the maximum flat plateau of the ideal binder concentration as that set forth in FIG. 5A.

On the other hand, when the principles of the present invention are not followed, the slopes of the leading and trailing edges of the binder areas fall to a much lower range and are in the range of from about 30° to about 55°. This is shown in FIG. 5C. As a result, the maximum flat plateau falls considerably and is in the range of from only about 30% to about 55% of the maximum flat plateau of the ideal set forth in FIG. 5A.

Another very important feature of the present invention is the ability to control or confine the total coverage of the binder areas on the bonded fabric. This is shown in FIG. 6 wherein the curves or histograms of three typical binder areas are superimposed. The solid line shows the ideal binder area with 90° slopes, maximum binder concentration in the binder area and minimum nonwoven fabric coverage. The dash line shows the present invention binder with slopes of about 85° and a flat plateau of about 92% of the ideal binder concentration. The dot-dash line shows binder applied not utilizing the present invention. The slopes are only about 45° and the flat plateau is only about 50% of the ideal binder concentration.

The migration of the ideal binder is 0%; the controlled total migration of the invention binder is less than about 200%, based on the ideal binder area, whereas the migration of non-invention binder is in excess of about 300% and up to about 800% based on the ideal binder area, all of such values including feathered areas.

FIG. 7 discloses graphs or histograms actually prepared from two samples of bonded nonwoven fabrics; one utilizing the principles of the present invention and the other not utilizing the principles of the present invention.

The average maximum level of the concentration of binder of the invention fabric has a relatively high peak relative Optical Density value of about 0.64 with a realtively low peak relative optical transparency value of about 0.23. These values are reached in less than 0.7 mm. (0.028 inch). The average level of the concentration of binder of the non-invention fabric has a relatively low peak relative Optical Density value of only about 0.35 with a relatively high peak relative optical transparency value of about 0.45. These values are reached in more than 1.6 mm. (0.064 inch).

The slopes of the invention binder curves are approximately 84° and 86° whereas the slopes of non-invention binder curves are approximately only 45° and 49°. The effective base of both binder areas, as originally laid down, is approximately 0.024 inch in width. The effective base of the invention binder curve in the final product is approximately 0.056 inch in width which equals a controlled total migration of 133%. The effective base of the non-invention binder in the final product is approximately 0.159 inch in width which equals a migration of over 560% due primarily to the large amount of feathering.

The same amount of binder is applied in both samples and the areas under each curve are the same. For a percentage add-on of binder of 24% applied in a six (0.024 inch) horizontal wavy line print pattern, this equals (for the invention binder) a surface coverage of 33.6% and a concentration of binder of 72% in the invention binder area. For the non-invention binder, the surface coverage is 95.4% and the average concentration of binder in the binder area is only 25.2% due to loss of binder which migrates into the feathered areas.

The invention binder fabric is strong and has textile-like softness, drape and hand. The other binder fabric is stiff and boardy.

The invention will be further illustrated in greater detail by the following specific examples. It should be understood, however, that although these examples may describe in particular detail some of the more specific features of the invention, they are given primarily for purposes of illustration and the invention in its broader aspects is not to be construed as limited thereto.

EXAMPLE I

A pad of woodpulp fibers is sprayed with a dilute ammonium hydroxide solution containing about 5% ammonia. A resin emulsion containing about 20% acrylic polymer solids, 1% by weight of the solids of zirconium sulfate, and a blue pigment is sprayed on the wood pulp pad. The resin emulsion has a pH of about 3. The pad is dried and examined. By observation the blue color indicates the resin is in the form of spherical particles on the outside fiber layer of the pad. The pad is soft yet has sufficient strength and absorbency to be useful as a sanitary pad. The above experiment is repeated with the exception that the zirconium sulfate is omitted. The resultant pad has a film of resin which has penetrated the woodpulp pad rendering the pad stiff, water repellent and unsuitable for use as a sanitary pad.

EXAMPLE II

A web of 100% rayon fibers, 1½ denier and 1½ inch in length is print-bonded by the rotogravure process using an engraved roll having 6 horizontal wavy lines per inch. The width of each line is about 0.018 inch. The composition of the resin used for the print-bonding is:

| | |
|---|---|
| Self cross-linking acrylic polymer, predominantly polyethyl acrylate polymerized with an anionic surfactant system | 40.3% |
| Ammonium Chloride catalyst | 0.4% |
| Anti-foaming agent | 0.4% |
| Zirconium Sulfate | 0.6% |
| Water | 57.9 |
| Blue Pigment | 0.4% |

In formulating the resin, the pH is brought to about 7 before the zirconium sulfate is added. The pH of the final formulated resin dispersion is about 2.5.

The rayon web is passed through a dilute solution of ammonium hydroxide in a mangle and the binder printed onto the wet, ammoniacal web. The binder coagulates instantly, fixing the resin in place with minimal lateral spread. The printed web is dried and cured.

The resultant fabric weighs about 250 grains per square yard.

A swatch of the resultant fabric is stained to accurately determine the location of the binder stripes. The binder stripe has a width of from about 0.032 inch to 0.036 inch. The softness of the fabric is measured with a Thwing-Albert Handle-O-Meter as about 82¼ units and the cross tensile strength of 8 piles of the fabric each 1 inch wide is 2.5 pounds.

EXAMPLE III

A fabric made as described in conjunction with Example II is made with the following differences:

(1) no zirconium sulfate is used in the resin formulation, (2) the web is not treated with ammonium hydroxide, and (3) 4 lines per inch instead of 6 lines per inch are used in the print-bonding pattern.

A swatch of the resultant fabric is stained to determine binder stripe width which is about 0.156 inch to 0.175 inch. The softness of the fabric is measured with a Thwing-Albert Handle-O-Meter as about 83½ units and the cross tensile strength of 8 plies of the fabric each 1 inch wide is 1.8 pounds.

EXAMPLE IV

Four different fabrics are made using similar base webs of 100% rayon fibers, 1½ denier and 1½ inch in length. Each fabric is print bonded with a self cross-linking acrylic resin of polyethyl acrylate polymerized with a non-ionic surfactant system. Two of the fabrics are bonded in a 6 line per inch pattern described in Example II and the other two fabrics are bonded with a similar pattern having only 4 lines per inch. In bonding one 6 line per inch fabric and one 4 line per inch fabric, about 0.2% by weight of the resin of zirconium sulfate is added to the resin emulsion and the web is treated with dilute ammonium hydroxide immediately prior to printing it with the resin emulsion. In the other 6 line per inch fabric and 4 line per inch fabric the zirconium sulfate and ammonium hydroxide treatment are omitted.

Each of the resultant fabrics is tested for tenacity in the machine and cross-directions and for stiffness in the machine and cross-directions. The tenacity is determined by finding the force required to break the fabric divided by the weight of the fabric. The stiffness is determined by measuring the force required to flex the fabric, i.e., the flexural resistance.

The following table gives the comparative results of the four different fabrics tested:

TABLE

| Sample No. | Zirconium Sulfate & Ammonium Hydroxide Treatment | Print Pattern (lines/inch) | Weight (grains/sq.yd.) | Tenacity (pounds/in/100 grains) Machine Direction | Tenacity (pounds/in/100 grains) Cross-Direction | Stiffness (mg. force) Machine Direction | Stiffness (mg. force) Cross-Direction |
|---|---|---|---|---|---|---|---|
| 4a | No | 4 | 670 | .58 | .052 | 30 | 2 |
| 4b | Yes | 4 | 580 | .71 | .074 | 7 | 1.1 |
| 4c | No | 6 | 720 | .60 | .079 | 32 | 3 |
| 4d | Yes | 6 | 610 | .74 | .081 | 9 | 0.7 |

As may be readily seen from this table, the addition of zirconium sulfate and the ammonium hydroxide treatment produces fabrics with higher tenacity in both the machine and cross-directions as well as fabrics which are not as stiff.

EXAMPLE V

A carded fiber web of 100% rayon fibers, 1½ denier and 1 9/16 inch staple length is print-bonded by the rotogravure process using an engraved roll having 6 horizontal wavy lines per inch. The width of each line on the roll is 0.024 inch. The resin composition (pH about 4.3) used for the print-bonding is:

(1) 1000 lbs. of a 50% solids dispersion of HA-8 (Rohm & Haas), a self cross-linking acrylic polymer, predominantly polyethyl acrylate, polymerized with a non-ionic surfactant system; and (2) 8.8 lbs. of a solution (40% solids) of 9 parts zirconium acetate and 1 part zirconium sulfate.

The carded fiber web is pre-treated and wet with 200% by weight of the fibers of a dilute 0.1% ammonium hydroxide solution whereby it is given a pH of about 10.

The print-bonding of the carded fiber web is otherwise conventional and follows standard plant manufacturing processing.

The acid binder dispersion (pH about 4.3) becomes basic, coagulates and precipitates substantially instantly upon contact with the alkaline ammonia-wet web (pH about 10) and controllably "freezes" the binder in place with a minimum of migration. The binder penetrates very uniformly, substantially completely through the wet web, which is further processed, dried and cured as usual. The width of the binder stripe in the final product is about 0.056 inch which represents a controlled total migration value of only about 133%. The surface coverage of the binder is about 33.6%. The final weight of the bonded nonwoven fabric is 650 grains per square yard. The total binder content is 21% or about 136 grains per square yard. The concentration of binder in the binder area is about 63% based on the weight of the fibers therein. The histogram for the concentration of binder in the binder area is shown in FIG. 8. This histogram is obtained by employing the optical reflectance principle wherein the incident light having a predetermined intensity is directed onto the surface of the bonded nonwoven fabric and reflected therefrom. The intensity of the reflected light is then determined, from which the "Optical Density" and the width of the binder stripe can be measured and the relative concentration of resin binder across the binder width can be evaluated.

Reference to the histogram in FIG. 8 reveals that the slopes of the curves are in the range of from 83° to 85°. The left hand slope which is believed to be the leading edge of the bond is particularly steep and rises from a zero binder concentration to a maximum binder concentration and peak "Optical Density" of 0.74 within a lateral length of only about 0.6 mm. or 0.024 inch. The right hand slope which is believed to be the trailing edge of the bond is slightly less steep and rises from a zero binder concentration to a maximum binder concentration and peak "Optical Density" of 0.74 in about 0.8 mm. or 0.032 inch. The optical density at one side of the bonded area (left hand side of "INVENTION BINDER" curve in FIG. 8) increases from about 0 to a value of at least 0.6 in moving a distance of less than about 1 mm. from the unbonded area directly into said bonded area; thereafter the optical density of the bonded area remains at or above a value of at least about 0.6 until it decreases substantially to 0 in moving a distance of less than about 1 mm. from said bonded area directly into the next unbonded area of the fabric (right hand side of "INVENTION BINDER" curve in FIG. 8).

The bonded nonwoven fabric has excellent strength, excellent softness, drape and hand, and excellent cross-resilience. It undergoes five standard home launderings with no appreciable damage or change in appearance.

EXAMPLE V(a)

The procedures of Example V are followed substantially as set forth therein except that the HA-8 self cross-linking acrylic polymer is replaced by polyvinyl acetate. No zirconium acetate or zirconium sulfate solution is used. All other conditions remain the same. Print bonding is conventional and follows standard plant manufacturing processing. Coagulation and precipitation of the binder is not very rapid. Processing, drying and curing are conventional. The width of the binder stripe in the final product is about 0.190 inch which represents a total uncontrolled migration of about 690%. The surface coverage of the binder is about 100% due to the large amount of feathering. The total binder content is about 21%. The average concentration of binder in the binder area is only about 21%, based on the weight of the fibers therein, due to the loss of binder which migrates into the feathered areas. The product is stiff and not soft and does not possess a desirable textile-like softness, drape or hand.

The histogram developed from an analysis of the resulting product is shown as a dot-dash curve in FIG. 8. It is to be observed that the peak optical density is about 0.35 whereas the peak optical density for the invention binder in FIG. 8 is 0.74. The slope of the curves are about 42° and 41° and rise very slowly from substantially zero binder concentration to substantially maximum binder concentration in relatively long distances of 2 mm. (0.08 inch) and 2.1 mm. (0.084 inch).

EXAMPLE V(*b*)

The procedures of Example V are followed substantially as set forth therein except that the HA-8 self cross-linking acrylic polymer is replaced by polyvinyl chloride. No zirconium acetate or zirconium sulfate solution is used. All other conditions remain the same. Print bonding is conventional and follows standard plant manufacturing processing. Coagulation and precipitation of the binder is not very rapid. Processing, drying and curing are conventional. The width of the binder stripe in the final product is about 0.166 inch which represents a total uncontrolled migration of about 590%. The surface coverage of the binder is almost 100% due to the migration of binder into the feathered areas. The total binder content is about 21%. The average concentration of binder in the binder area is about 21%, based on the weight of the fibers therein, due to the loss of binder which migrates into the feathered areas. The product is not soft and does not possess a desirable drape or hand.

The histogram developed from an analysis of the resulting product is shown as a dash curve in FIG. 8. It is to be observed that the peak optical density is about 0.37 whereas the peak optical density for the invention binder in FIG. 8 is 0.74. The slope of the curves are about 48° and 46° and very slowly rise from substantially zero binder concentration to substantially maximum binder concentration in relatively long distances of 1.8 mm. (0.072 inch) and 2 mm. (0.08 inch).

EXAMPLES VI & VII

A card web of 100% rayon fibers, 1½ denier and 1 9/16 inch staple length, is print bonded by the rotogravure process using an engraved roll having 4 horizontal wavy lines per inch. The width of each line on the roll is 0.024 inch. The resin composition for Example VI is identical to that set forth in Example V. The resin composition for Example VII, however, omits the zirconium salts and thus does not follow the principles of the present invention.

The card web is pre-treated and wet with 165% by weight of the fibers of a dilute ammonium hydroxide solution (0.07% $NH_3$) and has a pH close to about 10.

The print-bonding of the card web is otherwise conventional and follows standard plant manufacturing processing.

The acid binder dispersion (pH about 4.3) coagulates and precipitates when applied to the alkaline ammonia-wet web (pH about 10).

In the case of Example VI containing the zirconium salts, the coagulation and precipitation is extremely rapid. The nonwoven fabric is then treated, processed, dried and cured.

The width of the binder line in the final product is about 0.072 inch which represents a controlled total migration of about 200%. The binder content in the web, determined by chemical analysis, is about 14.6%. The weight of the bonded nonwoven fabric is about 650 grains per square yard. The weight of the binder is 95 grams per square yard. The binder surface coverage is about 28.8%. The concentration of binder in the binder area is about 51%, based on the weight of the fibers therein.

In the case of Example VII where there are no zirconium salts, the migration is uncontrolled and is much greater. The binder line spreads to about 0.175 inch which represents a migration of about 630%. The binder surface coverage is 70% of the nonwoven fabric. The binder content in the web, determined by chemical analysis, is about 14.7% and the average concentration of binder in the binder area is about 20.8%.

The bonded nonwoven fabric of Example VI has excellent strength, excellent softness, drape and hand and excellent cross-resilience. The bonded nonwoven fabric of Example VII neither has excellent strength, nor excellent softness, drape and hand nor excellent cross-resilience.

The graphs or histograms of FIG. 9 shows the difference in binder concentration and surface coverages of Examples VI and VII.

The slopes of the curves for Example VI are approximately 75° and 83° for the trailing and leading edges of the bond, whereas the slopes for the curves for Example VII are only about 46° and 51°. The curves for Example VI rapidly climb from zero to substantially maximum binder concentrations and peak optical density of 0.90 in about 1 mm. and 0.6 mm. (0.040 inch and 0.024 inch). The optical density at one side of a bonded area of the fabric of Example VI (left hand side of "INVENTION BINDER" curve in FIG. 9) increases from about 0 to a value of at least 0.6 in moving a distance of less than about 1 mm. from the unbonded area directly into said bonded area; thereafter the optical density of the bonded area remains at or above a value of at least about 0.6 until it decreases substantially to 0 in moving a distance of less than about 1 mm. from said bonded area directly into the next unbonded area of the fabric (right hand side of "INVENTION BINDER" curve in FIG. 9). In fact, the optical density at the left hand side of the INVENTION BINDER curve of FIG. 9 increases from substantially 0 to about 0.6 in moving a distance of approximately 0.4 mm. from the unbonded area directly into the bonded area; and the optical density at the right hand side of the same curve decreases from about 0.6 to substantially 0 in moving a distance of less than approximately 0.4 mm. directly from the bonded area into the next unbonded area of the fabric. In Example VII the longer distances required to reach peak optical density of 0.44 are each in excess of 2.5 mm. (0.100 inch).

EXAMPLE VIII

A fibrous web weighing 590 grains per square yard and comprising 100% rayon fibers 1½ denier and 1½ inches in length is intermittently print-bonded by the rotogravure process using an engraved roll having 4 horizontal wavy lines per inch, the width of each line, as measured on the engraved roll, being 0.024 inch.

The composition by weight of the resin binder formulation used for the print-bonding is:

| | |
|---|---|
| Self cross-linking acrylic polymer, predominantly polyethyl acrylate, polymerized with a non-ionic surfactant | 46.0% |
| Anti-foaming agent | 0.4% |
| Zirconium acetate-zirconium sulfate mixture (9:1 ratio) | 0.5% |
| Water | 53.1% |

The resin dispersion, as received, possesses a pH of 3. The final resin dispersion formulation has a pH of 4. The rayon web is passed through a dilute solution of ammonium hyroxide in a mangle, taking up ammonium hydroxide and becoming alkaline as a result. The acidic binder dispersion is then printed onto the wet, ammoniacal web. The pH of the binder dispersion is promptly increased to greater than 7 and the binder coagulates instantly, fixing the resin in place with minimal lateral spreading or diffusion. The printed web is dried and cured. The resulting bonded fabric weighs 690 grains per square yard. The bonded fabric thus contains 14.6% by weight of binder, based on the total weight of the bonded fabric.

A swatch of the resultant bonded fabric is stained to determine accurately the location of the binder stripes. The Optical Density method is used to determine the widths and relative concentrations of binder. The binder width in the finished fabric is 0.038 inch, which represents an increase due to migration of 58%. The surface coverage is 15.2%.

The bonded fabric is strong and is also very soft, due primarily to the fact that the binder is concentrated so heavily in the binder area and has not spread or migrated very much. There is 96% by weight of binder in the binder areas, based on the weight of the fibers in the binder areas.

EXAMPLE IX

The procedures of Example VIII are followed substantially as set forth therein except that the zirconium acetate-zirconium sulfate is omitted from the binder formulation.

The resultant bonded fabric is weaker than the bonded fabric of Example VIII and is not as soft. It is crisper, harsher and less textile-like. The final width of the binder stripe is 0.107 inch, thus indicating a lateral spread or migration of 346%. The surface coverage is 42.8%. There is, on the average, 34.2% by weight of binder in the binder areas, based on the weight of the fibers in the binder areas.

EXAMPLE X

Approximately 7 grams of the di-calcium salt of ethylenediaminetetraacetic acid is directly added with stirring to approximately 1400 grams of a polyvinyl acetate emulsion of about 55% solids. The emulsion contains approximately 720 grams of vinyl acetate polymer stabilized with about 35 grams of dodecyl benzene sulfonate with the remainder water. Sufficient ammonia is added to the emulsion to bring the pH to 8.

A fibrous web of 100% ray fibers, 1½ denier and 1½ inch in length is impregnated with a 0.5% aqueous solution of acetic acid. The above described resin emulsion is printed on the treated web in a pattern of four horizontal wavy lines per inch. At the moment of printing, the alkaline resin emulsion meets the acid web, liberating calcium ions and destroying the effectiveness of the anionic surfactant (dodecyl benzene sulfonate). The resin particles are immediately precipitated and not allowed to migrate excessively.

EXAMPLE XI

A fibrous web of 100% rayon fibers, 1½ denier and 1½ inch in length, weighing 500 grains per square yard, is impregnated to 100% by weight pick-up with a 0.2% aqueous solution of a salt of a complex polyamine. An example of such a salt is sold by the Rohm & Haas Company under the Trademark LUFAX 295.

A resin dispersion containing 40% by weight of a self cross-linking acrylic polymer which is predominantly ethyl acrylate, 0.4% of Ammonium Chloride catalyst, 0.4% of an antifoaming agent, with the remainder water is printed on the impregnated web in a pattern of six horizontal wavy lines per inch. The printing of the resin binder pattern on the fibrous web takes place while the fibrous web is still wet with the polyamine solution.

The width of each line printed is about 0.018 inch as measured on the engraved roll. The amount of resin solids applied is approximately 20% by weight of the web.

The printed fabric is dried at 270° F. for 30 seconds in contact with heated metal rollers. The resultant fabric weighs 600 grains per square yard. The width of the binder stripe in the resultant fabric is approximately 0.035 inch and extends completely through the fabric from the top surface to the bottom surface.

EXAMPLE XII

A fabric made as described in conjunction with Example XI is made with the exception that the salt of the complex polyamine is omitted from the initial impregnating aqueous solution. The width of the binder stripe in the resultant fabric is approximately 0.16 inch or almost 5 times as wide as the width of the binder stripe of the fabric of Example XI.

EXAMPLE XIII

The procedures of Example XI are followed substantially as set forth therein except that the fibrous web is dried after its impregnation with the polyamine solution. The resin binder dispersion is then printed with a similar 6-line pattern on the dried fibrous web. Study of the bonded fabric, after final drying, reveals that the resin binder is primarily on the top surface of the fabric and that it has not penetrated into the fabric to any significant extent. As a result, the fabric is substantially unbonded on its bottom surface. Such non-uniform bonding is undesirable and the product is unsatisfactory for use in the nonwoven fabric industry.

EXAMPLE XIV

The procedures set forth in Example XI are carried out substantially as set forth therein except that 0.2% of the polyethylene imine having a molecular weight of about 20,000 is substituted for the 0.2% of a salt of a complex polyamine. The results are comparable to those of Example XI. The resin bonding extends through the fibrous web from the top surface thereof to the bottom surface and the lateral migration of the binder is minimal.

EXAMPLE XV

The procedures set forth in Example XI are carried out substantially as set forth therein except that 0.5% of a cationic starch containing complex amine groups is substituted for the 0.2% of a salt of a complex polyamine. Results comparable to those of Example XI are obtained. The resin bonding extends completely through the fibrous web from the top surface thereof to the bottom surface. The lateral migration of the binder is minimal.

EXAMPLE XVI

The procedures of Example XI are followed substantially as set forth therein except that RETEN 210 (Hercules Chemical Co.), a strongly cationic, water-soluble, synthetic, complex polyamine having a very high molecular weight of at least about one million is used. After impregnation of the fibrous web with the polyamine and while the fibrous web is still wet, the resin dispersion is printed thereon. The results are satisfactory and are comparable to the results obtained in Example XI. The resin bonding extends completely through the fibrous web from the top surface to the bottom. The lateral migration of the binder is minimal.

EXAMPLE XVII

The procedures of Example XI are followed substantially as set forth therein with the exception that the resin dispersion contains approximately 45% by weight of a polyvinyl acetate-N-methylol acrylamide copolymer. The resin binder penetrates through the fabric very rapidly and bonds it satisfactorily from the top surface to the bottom surface. The lateral migration of the binder is minimal.

EXAMPLE XVIII

The procedures of Example XI are followed substantially as set forth therein except that the resin used is a polyvinyl acetate-ethyl acrylate copolymer. The results are comparable to those obtained in Example XI. The resin binder extends completely through the fibrous web and bonds it satisfactorily from the top surface to the bottom surface. The lateral migration of the binder is minimal.

EXAMPLE XIX

The procedures of Example XI are followed substantially as set forth therein except that the resin used is a methyl methacrylate-ethyl acrylate copolymer. The results are comparable to those obtained in Example XI. The resin binder extends completely through the fibrous web and bonds it satisfactorily from the top surface to the bottom surface. The lateral migration of the binder is minimal.

EXAMPLE XX

The procedures of Example XI are followed substantially as set forth therein except that the resin used is a methyl methacrylate-ethyl hexyl acrylate copolymer. The results are comparable to those obtained in Example XI. The resin binder extends completely through the fibrous web and bonds it satisfactorily from the top surface to the bottom surface. The lateral migration of the binder is minimal.

EXAMPLE XXI

The procedures of Example XI are followed substantially as set forth therein except that the resin used is a butyl acrylate-methyl methacrylate copolymer. The results are comparable to those obtained in Example XI. The resin binder extends completely through the fibrous web and bonds it satisfactorily from the top surface to the bottom surface. The lateral migration of the binder is minimal.

EXAMPLE XXII

A fibrous card web weighing about 570 grains per square yard and comprising 100% rayon fibers 1½ denier and 1½ inches in length is intermittently print-bonded by the rotogravure process using an engraved roll having 6 horizontal wavy lines per inch. The width of each line as measured on the engraved roll is 0.024 inch.

The composition by weight of the resin binder formulation used for the intermittent print-bonding is:

(1) 100 lbs. of a 50% solids latex of GAF 243 terpolymer of butadiene (46%), styrene (51%), and $\alpha,\beta$-unsaturated carboxylic acid (2%).
(2) 40 lbs. of distilled water.
(3) 10 lbs. of a 10% solution of a thickening agent, Acrysol 51, a copolymer of acrylic acid.
(4) 150 grams "Pluronic L101" Polyol ethylene oxide condensates of hydrophobic bases of propylene oxide and propylene glycol nonionic surfactant.
(5) 900 grams of a 48% solution of zinc tetrammine sulfate metal coordination complex containing 17% zinc oxide equivalent or 1 lb. zinc tetrammine sulfate (actual).

The resin dispersion, as prepared, has a pH of 9. The fibrous web is pretreated and wet with 165% of its weight of acetic acid (0.1%) to bring it to a pH below 7 and wherein it possesses sufficient acidity to more than neutralize the alkaline pH of the resin dispersion which is to be applied thereto.

The alkaline binder dispersion is then printed onto the wet, acetic acid treated fibrous web in the form of a 6-line intermittent print pattern. The pH of the binder dispersion is immediately decreased to less than 7 and web and migration is held to a minimum. Conventional processing, drying, and curing are employed. The resulting bonded nonwoven fabric has excellent softness, drape and hand, and excellent cross-resilience.

EXAMPLE XXIX

The procedures of Example XXII are followed substantially as set forth therein with the exception that the percentage of the $\alpha,\beta$ -unsaturated carboxylic acid is increased to 6% and the percentages of the butadiene and styrene are proportionately decreased.

The carboxylated terpolymer resin binder dispersion coagulates and precipitates substantially immediately upon being printed on the acetic acid treated fibrous web and migration is held to a minimum. Conventional processing, drying, and curing are employed. The resulting bonded nonwoven fabric has excellent strength, excellent softness, drape and hand, and excellent cross-resilience.

EXAMPLE XXX

The procedures of Example XXII are followed substantially as set forth therein with the exception that the quantity of the coordination complex is decreased from 900 grams zinc tetrammine sulfate to 450 grams or ½ lb. zinc tetrammine sulfate (actual).

The carboxylated terpolymer resin binder dispersion coagulates and precipitates substantially immediately upon being printed on the acetic acid treated fibrous web and migration is held to a minimum. Conventional processing, drying, and curing are employed. The resulting bonded nonwoven fabric has excellent strength, excellent softness, drape and hand, and excellent cross-resilience.

EXAMPLE XXXI

The procedures of Example XXII are followed substantially as set forth therein with the exception that the quantity of the coordination complex is increased from 900 grams zinc tetrammine sulfate to 1350 grams or 1½ lbs. zinc tetrammine sulfate (actual).

The carboxylated terpolymer resin binder dispersion coagulates and precipitates substantially immediately upon being printed on the acetic acid treated fibrous web and migration is held to a minimum. Conventional processing, drying, and curing are employed. The resulting bonded nonwoven fabric has excellent strength, excellent softness, drape and hand, and excellent cross-resilience.

EXAMPLE XXXII

The procedures of Example XXII are followed substantially as set forth therein with the exception that the butadiene-styrene $\alpha,\beta$ -unsaturated acid terpolymer is replaced by Goodrich 2600X83 copolymer of an acrylic resin with an $\alpha,\beta$ -unsaturated carboxylic acid. An anionic surfactant is used in this formulation.

The carboxylated copolymer resin binder dispersion coagulates and precipitates substantially immediately upon being printed on the acetic acid treated fibrous web and migration is held to a minimum. Conventional processing, drying, and curing are employed. The resulting bonded nonwoven fabric has excellent strength, excellent softness, drape and hand, and excellent cross-resilience.

EXAMPLE XXXIII

The procedures of Example XXII are followed substantially as set forth therein with the exception that the terpolymer used therein is replaced by National Starch P306-3, a copolymer of 97% acrylic monomer and 3% acrylic acid with an anionic surfactant system.

The carboxylated copolymer resin binder dispersion coagulates and precipitates substantially immediately upon being printed on the acetic acid treated fibrous web and migration is held to a minimum. Conventional processing, drying, and curing are employed. The resulting bonded nonwoven fabric has excellent strength, excellent softness, drape and hand, and excellent cross-resilience.

EXAMPLE XXXIV

The procedures of Example XXII are followed substantially as set forth therein with the exception that the terpolymer used therein is replaced by a terpolymer of ethylene, vinyl acetate, and an $\alpha,\beta$ -unsaturated carboxylic acid.

The carboxylated terpolymer resin binder dispersion coagulates and precipitates substantially immediately upon being printed on the acetic acid treated fibrous web and migration is held to a minimum. Conventional processing, drying, and curing are employed. The resulting bonded nonwoven fabric has excellent strength, excellent softness, drape and hand, and excellent cross-resilience.

EXAMPLE XXXV

The procedures of Example XXII are carried out substantially as set forth therein except that the GAF 243 carboxylated butadiene-styrene terpolymer is replaced by an equivalent amount of a terpolymer of 51% butadiene, 48% styrene, and 2% acrylic acid.

The carboxylated terpolymer resin binder dispersion coagulates and precipitates substantially immediately upon being printed on the acetic acid treated fibrous web and the total migration is held to a minimum. Conventional processing, drying, and curing are employed. The resulting bonded nonwoven fabric is generally comparable to the bonded nonwoven fabric obtained in Example XXII.

EXAMPLE XXXVI

The procedures of Example XXII are carried out substantially as set forth therein except that the GAF 243 carboxylated butadiene-styrene terpolymer is replaced by an equivalent amount of a terpolymer of 51% butadiene, 48% styrene, and 2% methacrylic acid.

The carboxylated terpolymer resin binder dispersion coagulates and precipitates substantially immediately upon being printed on the acetic acid treated fibrous web and the total migration is held to a minimum. Conventional processing, drying, and curing are employed. The resulting bonded nonwoven fabric is generally comparable to the bonded nonwoven fabric obtained in Example XXII.

EXAMPLE XXXVII

The procedures of Example XXXVI are followed substantially as set forth therein with the exception that the resin formulation comprises 46% butadiene, 51% styrene, and 2% itaconic acid, plus a sodium salt of a phosphate ester as an anionic surfactant mixture. Coagulation and precipitation take place satisfactorily. Total the binder coagulates and precipitates instantly, fixing the resin in place on the web with controlled minimal lateral spreading or diffusion. The printed web is then processed, dried and cured in conventional fashion. The resulting bonded nonwoven fabric weighs 690 grains per square yard and contains 17.4% by weight of binder based on the total weight of the bonded nonwoven fabric.

The binder line possesses a width of 0.066 in the final dried fabric which represents a controlled total migration of about 190%. The surface coverage of the binder is 26.4% of the nonwoven fabric and the concentration of binder in the binder area is 66%, based on the weight of the fibers therein.

The bonded nonwoven fabric has excellent strength, excellent softness, drape and hand, and excellent cross-resilience.

The histogram of FIG. 10 graphically depicts the advantages of the present invention. The slopes of the curves are 78° (presumably the trailing bond edge) and 83° (presumably the leading edge of the bond) and it requires only 0.6 mm. and 0.8 mm. (0.024 inch and 0.032 inch) to increase from zero to substantially maximum concentration of binder in the binder area at 0.80 Optical Density and 0.16 Optical Transparency. The optical density at one side of a bonded area of the fabric of Example XXII (left hand side of "INVENTION BINDER" curve in FIG. 10) increases from about 0 to a value of at least 0.6 in moving a distance of less than about 1 mm. from the unbonded area directly into said bonded area; thereafter the optical density of the bonded area remains at or above a value of at least about 0.6 until it decreases substantially to 0 in moving a distance of less than about 1 mm. from said bonded area directly into the next unbonded area of the fabric (right hand side of "INVENTION BINDER" curve in FIG. 10). In fact, the optical density at the left hand side of the INVENTION BINDER curve of FIG. 10 increases from substantially 0 to about 0.6 in moving a distance of approximately 0.5 mm. from the unbonded area directly into the bonded area; and the optical density at the right hand side of the same curve decreases from about 0.6 to substantially 0 in moving a distance of approximately 0.3 mm. directly from the bonded area into the next unbonded area of the fabric.

EXAMPLE XXII(*a*)

The procedures of Example XXII are followed substantially as set forth therein except that the carboxylated butadiene styrene polymer is replaced by polyvinyl acetate. No zinc tetrammine sulfate solution is used. All other conditions remain the same. Print-bonding is conventional and follows standard plant manufacturing processing. Coagulation and precipitation of the binder is not very rapid. Processing, drying and curing are conventional. The width of the binder stripe in the final product is about 0.170 inch which represents a total migration of about 610% due to the migration of binder into the feathered areas. The surface coverage of the binder is about 100%, again, due to the migration of binder into the feathered areas. The total binder content is about 17.4%. The average concentration of binder in the binder area is about 17.4%, based on the weight of the fibers therein. The product is stiff and not soft and does not possess a desirable drape or hand.

The histogram developed from an analysis of the resulting product is shown as a dash curve in FIG. 10. It is to be observed that the peak Optical Density is about 0.36 whereas the peak Optical Density for the invention binder in FIG. 10 is 0.80. The slope of the curves are about 46° and 50° and rise from substantially zero binder concentration to substantially maximum binder concentration in relatively long distances of 1.8 mm. (0.72 inch) and 2.0 mm. (0.80 inch).

EXAMPLE XXIII

The procedures of Example XXII are followed substantially as set forth therein with the exception that the coordination complex compound is zinc tetrammine carbonate rather than zinc tetrammine sulfate. The results are generally comparable and the bonded nonwoven fabric is generally comparable to the bonded nonwoven fabric obtained in Example XXII.

EXAMPLE XXIV

The procedures of Example XXII are followed substantially as set forth therein except that the zinc tetrammine sulfate is replaced by ammonium zirconyl carbonate, The results are generally comparable and the resulting bonded nonwoven fabric possesses properties and characteristics generally similar to that obtained in the bonded nonwoven fabric of Example XXII.

EXAMPLE XXV

The procedures of Example XXII are followed substantially as set forth therein exept that the zinc tetrammine sulfate is replaced by sodium tetrahydroxo zincate. The results are generally comparable and the resulting bonded nonwoven fabric possesses properties and characteristics generally similar to those obtained in the bonded nonwoven fabric of Example XXII.

EXAMPLE XXVI

The procedures of Example XXII are followed substantially as set forth therein except that the zinc tetrammine sulfate is replaced by sodium tetrahydroxo aluminate. The results are generally comparable and the resulting bonded nonwoven fabric possesses properties and characteristics generally similar to those obtained in the bonded nonwoven fabric of Example XXII.

EXAMPLE XXVII

The procedures of Example XXII are followed substantially as set forth therein with the exception that the percentage of the $\alpha,\beta$ -unsaturated carboxylic acid is decreased to 1% and the percentages of the butadiene and sytrene are proportionately increased.

The carboxylated terpolymer resin binder dispersion coagulates and precipitates substantially immediately upon being printed on the acetic acid treated fibrous web and migration is held to a minimum. Conventional processing, drying, and curing are employed. The resulting bonded nonwoven fabric has excellent strength, excellent softness, drape and hand, and excellent cross-resilience.

EXAMPLE XXVIII

The procedures of Example XXII are followed substantially as set forth therein with the exception that the percentage of the $\alpha,\beta$ -unsaturated carboxylic acid is increased to 4% and the percentages of the butadiene and styrene are proportionately decreased.

The carboxylated terpolymer resin binder dispersion coagulates and precipitates substantially immediately upon being printed on the acetic acid treated fibrous migration is controlled and held to a minimum. The resulting bonded nonwoven fabric is generally comparable to the bonded nonwoven fabric obtained in Example XXXVI.

EXAMPLE XXXVIII

The procedures of Example XXII are followed substantially as set forth therein with the exception that the rayon fibers are replaced by bleached cotton fibers.

The results are comparable and the resulting nonwoven fabric has excellent strength, excellent softness, drape and hand, and excellent cross-resilience.

EXAMPLE XXXIX

The procedures of Example XXII are followed substantially as set forth therein with the exception that water-insoluble polyvinyl alcohol fibers (Kurashiki - 2.5 denier) are used instead of the rayon fibers.

The results are comparable and the properties and characteristics of the resulting nonwoven fabric are excellent, particularly with regard to strength, both wet and dry.

Having now described the invention in specific detail and exemplified the manner in which it may be carried into practice, it will be readily apparent to those skilled in the art that innumerable variations, applications, modifications, and extensions of the basic principles involved may be made without departing from its spirit and scope.

What is claimed is:

1. A bonded, fibrous nonwoven textile fabric having excellent strength and textile-like softness, drape and hand comprising: a fibrous web of overlapping, intersecting fibers, said fibrous web comprising bonded areas and unbonded areas having boundaries therebetween, said bonded areas being spaced from said unbonded areas in a predetermined, intermittent pattern; the fibers in said bonded areas being bonded with from about 50% to about 120% by weight, based on the weight of the fibers therein, of a synthetic resin; said boundaries being sharp and distinct and being substantially free of binder feathering and wherein (a) the optical density at one side of said bonded areas increases from approximately 0 to a value of at least 0.6 in moving a distance of less than about 1 mm. from an unbonded area directly into a bonded area;

(b) the optical density of said bonded areas is at least 0.6; and (c) the optical density at the other side of said bonded areas decreases to substantially zero in moving a distance of less than about 1 mm. from said bonded area directly into the next unbonded area.

2. A bonded, fibrous nonwoven textile fabric as defined in claim 1, wherein said synthetic resin has a hydroxy-containing coordinating ligand.

3. A bonded, fibrous nonwoven textile fabric as defined in claim 2, wherein the hydroxy-containing coordinating ligand is the carboxy radical.

4. A bonded, fibrous nonwoven textile fabric as defined in claim 2, wherein said synthetic resin is a carboxylated resin.

5. A bonded, fibrous nonwoven textile fabric as defined in claim 4, wherein said carboxylated resin is a polymerization product of from about 1% to about 8% by weight of a $\alpha,\beta$-unsaturated carboxylic acid and from about 99% to about 92% by weight of a monomer or mixture of monomers copolymerizable therewith.

6. A bonded, fibrous nonwoven textile fabric as defined in claim 5, wherein the $\alpha,\beta$-unsaturated carboxylic acid contains from 3 to 5 carbon atoms.

7. A bonded, fibrous nonwoven textile fabric as defined in claim 5, wherein the $\alpha,\beta$-unsaturated carboxylic acid is acrylic acid.

8. A bonded, fibrous nonwoven textile fabric as defined in claim 5, wherein the $\alpha,\beta$-unsaturated carboxylic acid is methacrylic acid.

9. A bonded, fibrous nonwoven textile fabric as defined in claim 5, wherein the $\alpha,\beta$-unsaturated carboxylic acid is itaconic acid.

10. A bonded, fibrous nonwoven textile fabric as defined in claim 5, wherein the $\alpha,\beta$-unsaturated carboxylic acid is copolymerized with butadiene and styrene.

11. A bonded, fibrous nonwoven textile fabric as defined in claim 5, wherein the $\alpha,\beta$-unsaturated carboxylic acid is acrylic acid and the monomer with which it is copolymerized is an acrylic monomer.

12. A bonded, fibrous nonwoven textile fabric as defined in claim 5, wherein the $\alpha,\beta$-unsaturated caboxylic acid is copolymerized with ethylene and vinyl acetate.

13. A bonded, fibrous nonwoven textile fabric having excellent strength and textile-like softness, drape and hand comprising: a fibrous web of overlapping, intersecting fibers, said fibrous web comprising bonded areas and unbonded areas having boundaries therebetween, said bonded areas being spaced from said unbonded areas in a predetermined, intermittent pattern; the fibers in said bonded areas being bonded with from about 50% to about 120% by weight, based on the weight of the fibers therein, of a synthetic resin; said boundaries being sharp and distinct and being substantially free of binder feathering; said nonwoven fabric being characterized by an optical density—distance curve which graphically displays optical density as a function of distance in millimeters traversed in moving sequentially:

(a) from a first of said unbonded areas directly into one of said bonded areas;

(b) across said one of said bonded areas; and (c) from said one of said bonded areas directly into a next adjacent unbonded area;

said optical density—distance curve across said bonded area being generally bell-shaped and having two slopes, each of said slopes being at least 75°.

* * * * *